US010030938B2

(12) United States Patent
Faifer

(10) Patent No.: US 10,030,938 B2
(45) Date of Patent: Jul. 24, 2018

(54) RECEIVER COVER AND ACCESSORY RAIL

(71) Applicant: Sagi Faifer, Mishmar Hashiva (IL)

(72) Inventor: Sagi Faifer, Mishmar Hashiva (IL)

( * ) Notice: Subject to any disclaimer, the term of this patent is extended or adjusted under 35 U.S.C. 154(b) by 0 days.

(21) Appl. No.: 15/217,650

(22) Filed: Jul. 22, 2016

(65) Prior Publication Data

US 2017/0023333 A1 Jan. 26, 2017

Related U.S. Application Data

(60) Provisional application No. 62/195,791, filed on Jul. 22, 2015.

(51) Int. Cl.
*F41G 11/00* (2006.01)
*F41A 3/66* (2006.01)

(52) U.S. Cl.
CPC ..... *F41G 11/003* (2013.01); *F41A 3/66* (2013.01); *F41G 11/004* (2013.01)

(58) Field of Classification Search
CPC .. F41A 3/64; F41A 3/66; F41G 11/003; F41G 11/004; F41G 11/005; F41G 11/007
USPC ..... 89/199, 17; 42/71.01, 75.01, 75.03, 83, 42/85, 96
See application file for complete search history.

(56) References Cited

U.S. PATENT DOCUMENTS 5,581,926 A * 12/1996 Taalib-din ..... F41A 3/82 42/16
7,261,029 B1 * 8/2007 Davis ..... F41A 17/36 42/16
7,882,655 B1 * 2/2011 Nesseth ..... F41G 1/12 42/111
8,266,998 B1 * 9/2012 Davis ..... F41A 3/72 42/71.01
2012/0102804 A1 * 5/2012 Fesas ..... F41A 3/66 42/90
2012/0131838 A1 * 5/2012 Edge ..... F41G 11/006 42/90
2014/0068994 A1 * 3/2014 Schultz ..... F41G 11/003 42/124

(Continued)

FOREIGN PATENT DOCUMENTS

WO WO2017077399 A2 5/2017
WO PCT/IB2016/001991 6/2017

OTHER PUBLICATIONS

ISR (PCT/IB2016/001991), dated Jun. 1, 2017.

*Primary Examiner* — Bret Hayes
(74) *Attorney, Agent, or Firm* — Law Office of Arthur M. Antonelli, PLLC

(57) ABSTRACT

A cover for a receiver of a gun that may include an elongated member having a first longitudinal axis, the elongated member including a distal end portion which may include a leading edge which is configured and dimensioned to connect with a gun part, and a proximal end portion which is spaced from the distal end portion along the first longitudinal axis. The elongated member may include a first locking mechanism adjacent the proximal end wall. The first locking mechanism may be secured to a recoil spring guide of the gun. Also, the elongated member may include a second locking mechanism adjacent the distal end portion. The second locking mechanism may be secured to a rear sight base of the gun. The elongated member may include an accessory rail.

20 Claims, 29 Drawing Sheets

(56) References Cited

U.S. PATENT DOCUMENTS

2015/0247688 A1* 9/2015 Zonshine ..... F41A 3/68
42/8
2015/0330727 A1* 11/2015 Kolev ..... F41A 3/12
42/16

* cited by examiner

RECEIVER COVER AND ACCESSORY RAIL

CROSS REFERENCE TO RELATED APPLICATIONS

This application claims the benefit of U.S. Provisional Application No. 62/195,791 filed on Jul. 22, 2015. U.S. Provisional Application No. 62/195,791 is incorporated by reference herein in its entirety.

FIELD OF THE INVENTION

The invention relates to a receiver cover for a small arms weapon. More particularly, the invention relates to a receiver cover for a gun, such as an AK-47 variant rifle.

BACKGROUND

A firearm operator may find it advantageous to have specialized optical sighting equipment (or other tactical accessories) mounted on their service weapon. Accordingly, there exists a need for a receiver cover for a gun which may provide a stable platform for mounting a tactical accessory.

SUMMARY

Hence, the present disclosure is directed toward a cover for a receiver of a gun that includes an elongated member having a first longitudinal axis, the elongated member including a distal end portion which includes a leading edge which is configured and dimensioned to connect with a gun part, and a proximal end portion which is spaced from the distal end portion along the first longitudinal axis. The elongated member may include a proximal end wall, a proximal rim adjacent the proximal end wall, and a first locking mechanism adjacent the proximal end wall. The first locking member, may include an anchor, a positioning member connected to the anchor such that movement of the positioning member moves the anchor with respect to the proximal rim. The locking mechanism may include a blocking member operatively associated with the positioning member. The first locking mechanism may include first and second operable configurations such that in the first configuration the blocking member arrests movement of the positioning member, and such that in the second configuration the blocking member allows movement of the positioning member.

The positioning member may be movable with respect to the anchor. The positioning member may be rotatable with respect to the anchor. The positioning member and the anchor may be connected by mating screw threads. Rotation of the positioning member in one direction may move the anchor away from the proximal rim. Counter rotation of the positioning member may move the anchor toward the proximal rim.

The anchor may include a body which has a first surface, a second surface spaced from the first surface, and a passage extending from the first surface toward the second surface. The passage may include a first side wall. The first side wall may be situated between the proximal rim and the blocking member. The first side wall may be positioned to anchor against a recoil spring guide of a gun, such as an AK-47 variant rifle. The passage may extend from the first surface to the second surface.

The positioning member may include a shaft that is connected to the body. The positioning member further may include a knob connected to the shaft such that moving the knob regulates the position of the anchor with respect to the proximal rim. The shaft may have a second longitudinal axis and the knob may be rotatable about the second longitudinal axis. The knob may be fixed to the shaft. The knob may include a first exterior surface, and the first exterior surface may include a plurality of recesses, the plurality of recesses being selectively positionable opposite the locking member. Each of the plurality of recesses may be configured and dimensioned to engage the locking member to fix the position of the knob. The locking member may include a smooth ball spring plunger.

The cover may include a second locking mechanism adjacent the distal end portion. The second locking mechanism may include a lever which includes a distal end and a proximal end, the distal end of the lever being positioned adjacent the leading edge. The second locking mechanism may include a biasing member positioned between the elongated member and the lever. The second locking mechanism may include third and fourth configurations such that in the third configuration the distal end of the lever is biased toward the leading edge, and such that in the fourth configuration the proximal end of the lever compresses the biasing member.

The elongated member may form a housing that is configured and dimensioned to releasably connect to a receiver of a gun, such as an AK-47 variant rifle. The elongated member may include a tactical accessory rail.

DESCRIPTION OF THE DRAWINGS

In the accompanying drawings, which form part of this specification and are to be read in conjunction therewith and in which like reference numerals are used to indicate like parts in the various views.

DESCRIPTION

Figure 1:
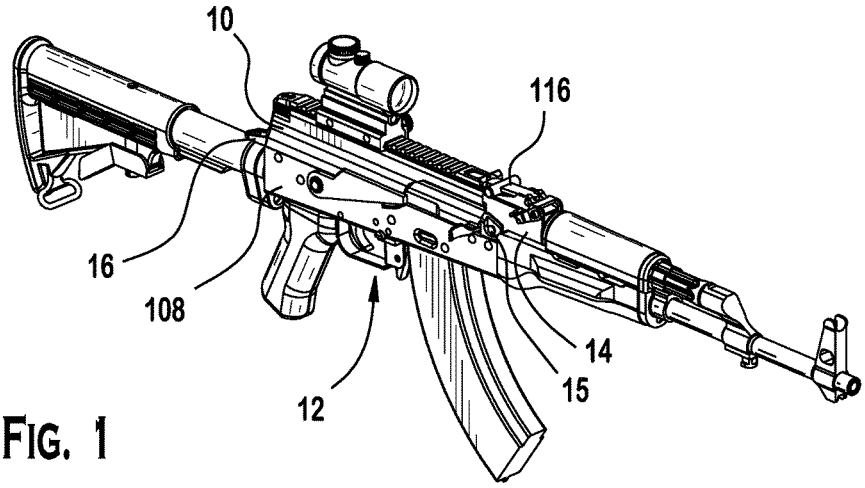
FIG. 1 is a perspective view of a rifle with an exemplary embodiment of a receiver cover.
Figure 2:
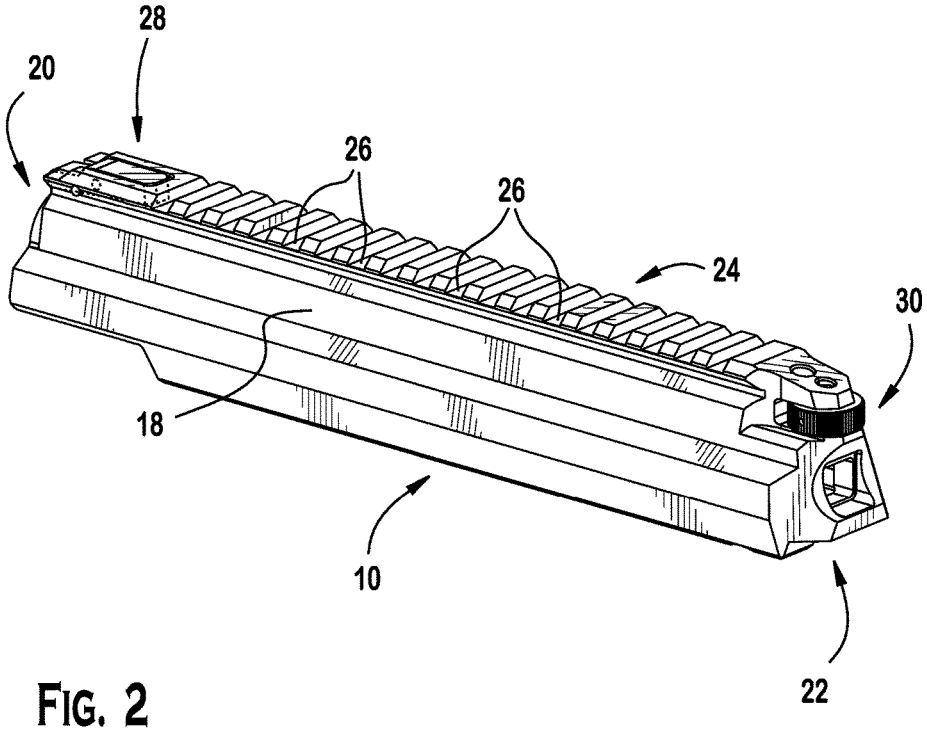
FIG. 2 is an upper rear port side perspective view of the receiver cover of FIG. 1.
Figure 3:
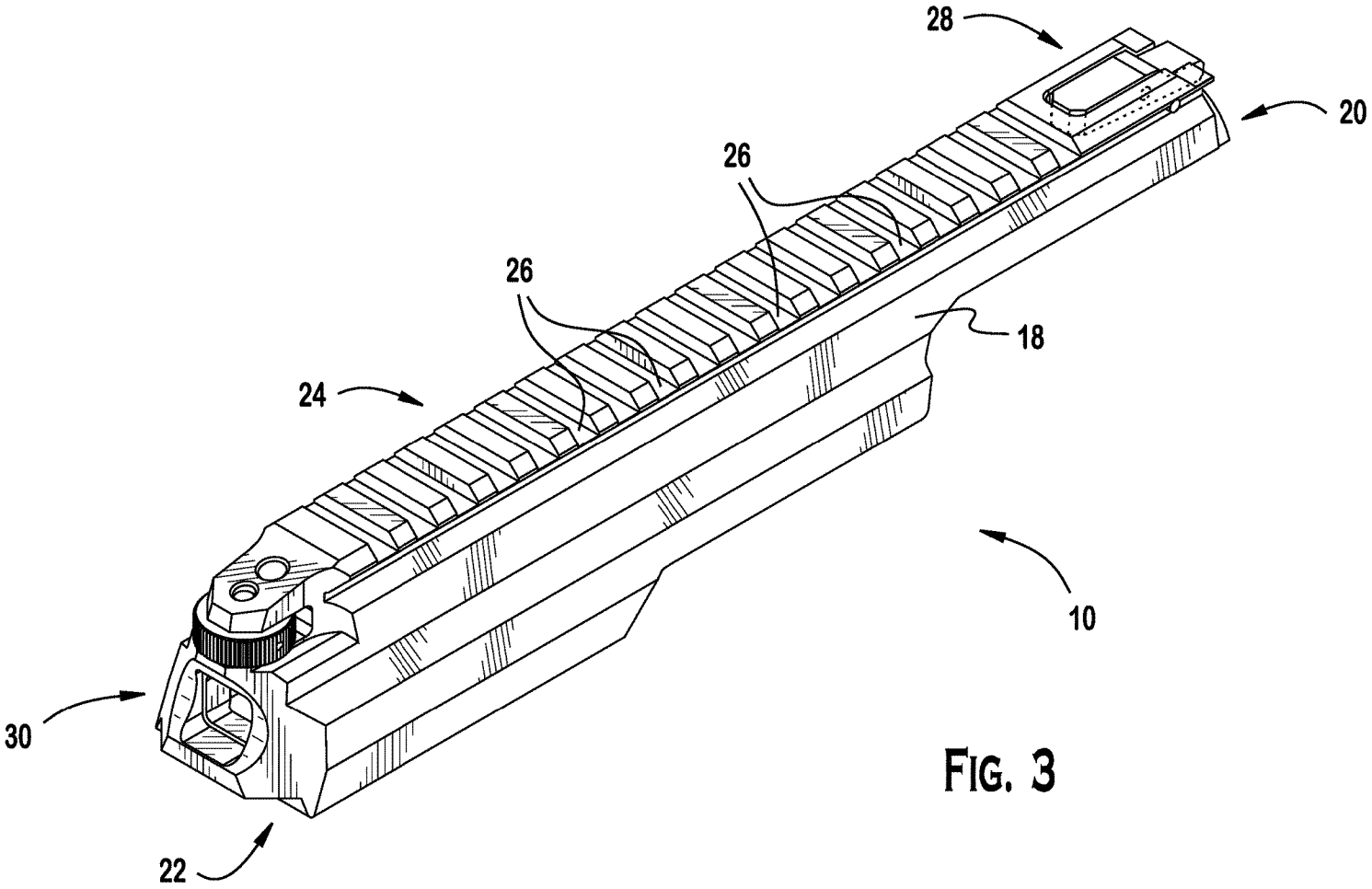
FIG. 3 is an upper rear starboard side perspective view of the receiver cover of FIG. 1.

FIG. 1 shows an exemplary embodiment of a receiver cover 10 for an AK-47 variant rifle 12 in accordance with the present invention. The receiver cover may be configured and dimensioned to interlock with component parts of an AK-47 variant rifle (e.g., the rear sight base 14 and rear trunnion 16). Referring to FIG. 2 the receiver cover 10 may include an elongated cover portion 18 that includes a rear sight base connection site 20, a rear trunnion connection site 22, and an accessory rail (e.g., a Picatinny rail) 24. As shown in FIG. 2 and FIG. 3, the accessory rail may include a plurality of recoil grooves 26. The plurality of recoil groves 26 may be uniformly spaced along the longitudinal axis of the accessory rail. The shape and orientation of the plurality of recoil grooves may be the same, and the plurality of recoil grooves may be parallel grooves. The accessory mounting rail may be a Picatinny rail that meets the requirements of MIL-STD-1913. Also, the receiver cover may include a distal end receiver cover locking mechanism 28 and a proximal end receiver cover locking mechanism 30.

Figure 4:
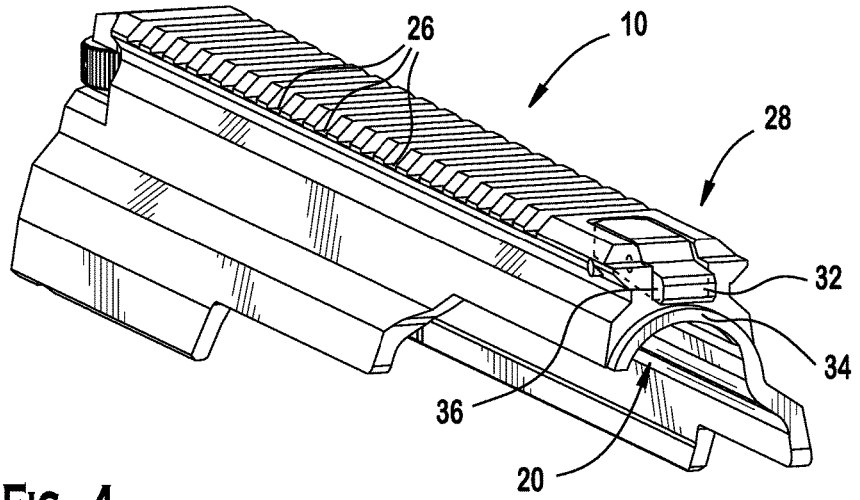
FIG. 4 is an upper front starboard side perspective view of the receiver cover of FIG. 1.
Figure 22:
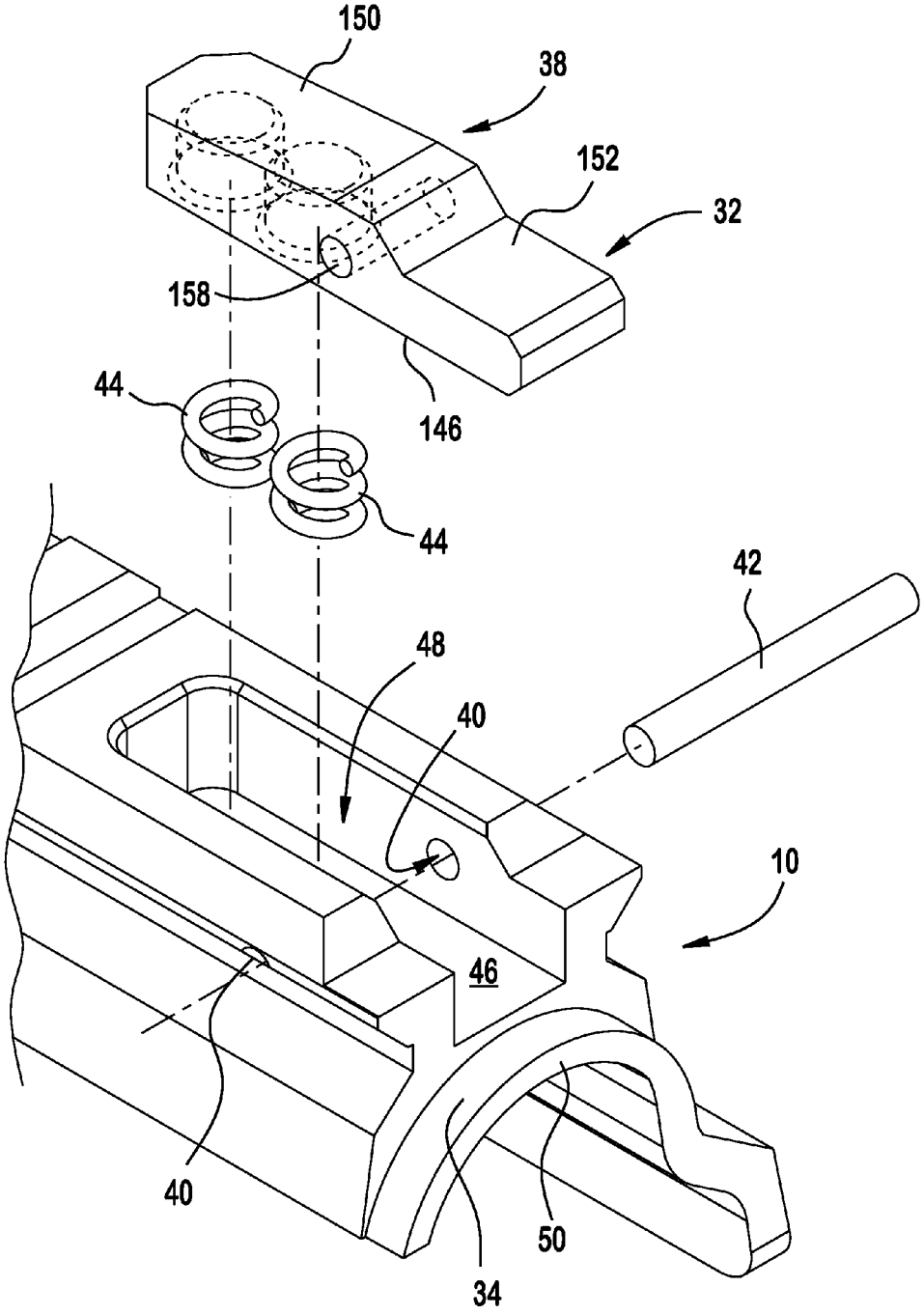
FIG. 22 is an exploded view of the locking mechanism at the front of the receiver cover of FIG. 1.
Figure 23:
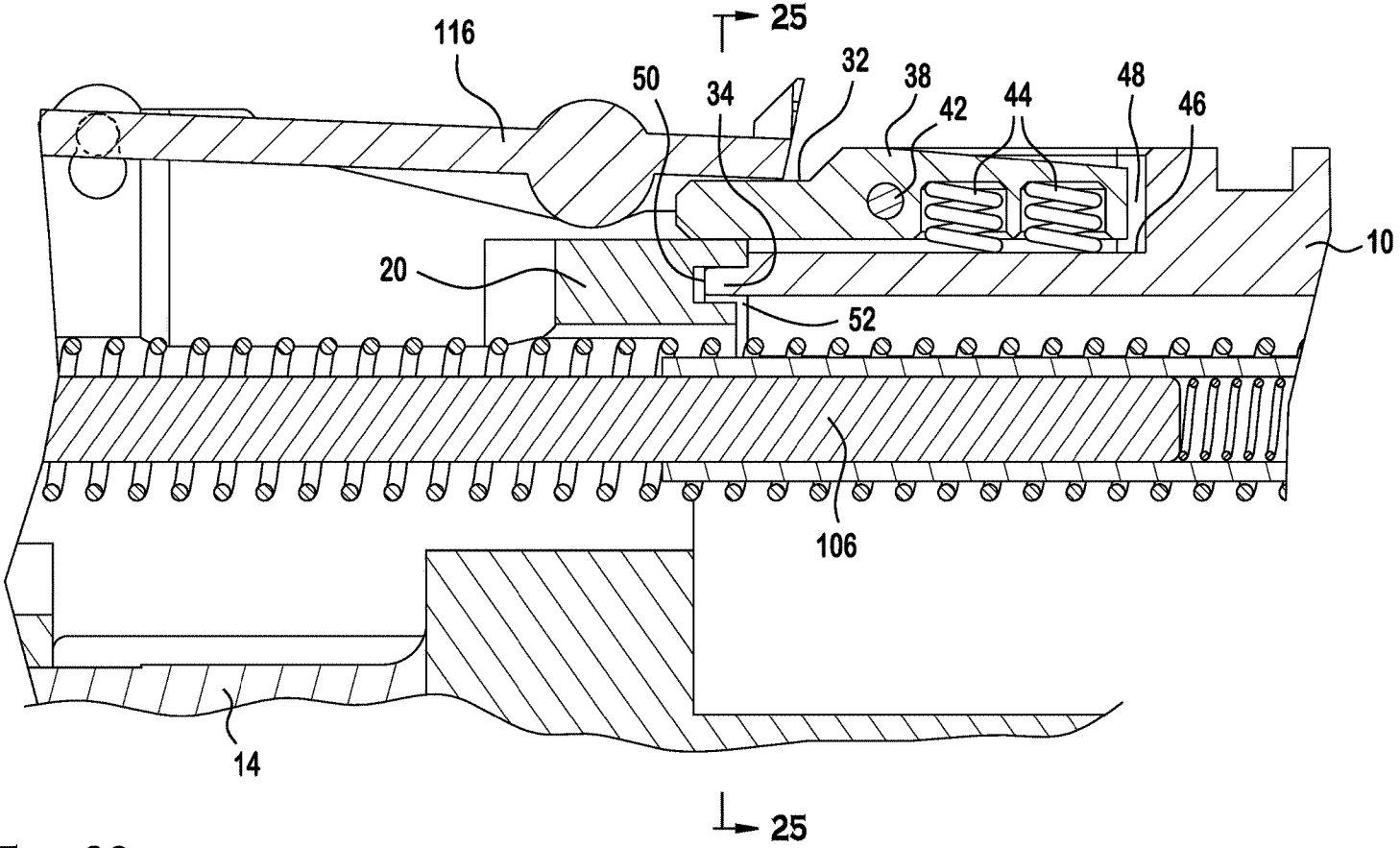
FIG. 23 is a cross sectional view of FIG. 11, along line 23-23.
Figure 24:
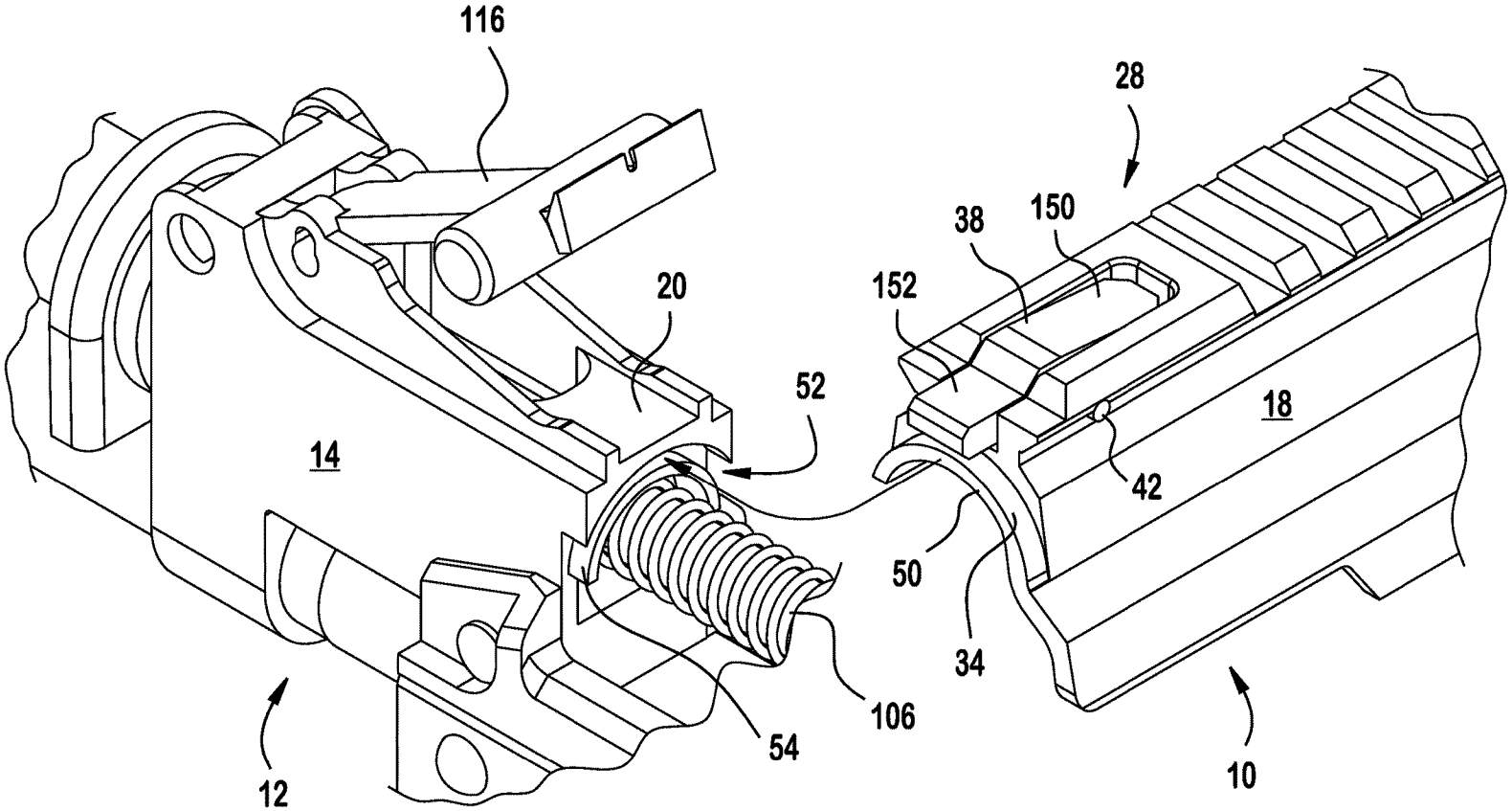
FIG. 24 is a perspective view of selected components of FIG. 10.
Figure 25:
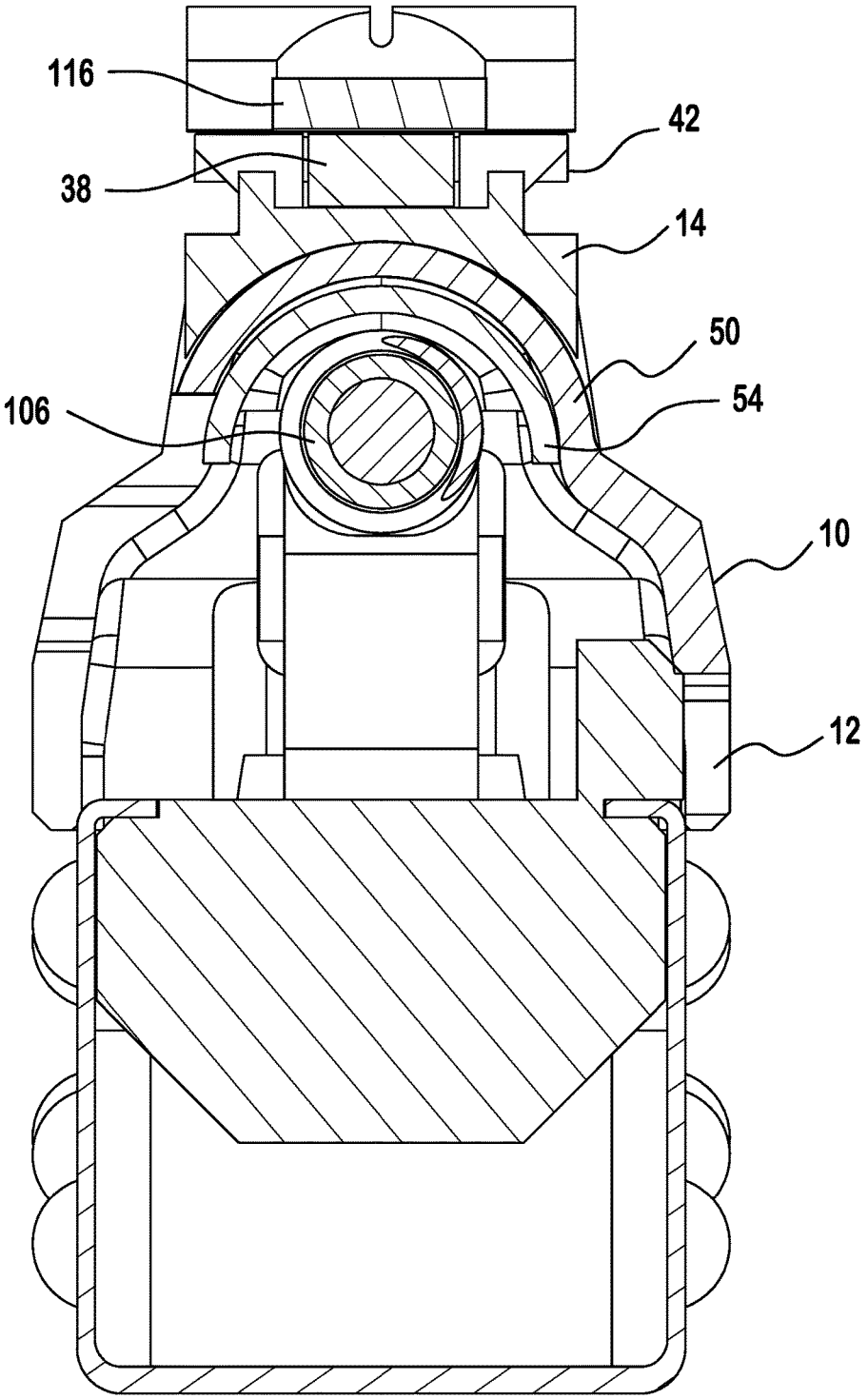
FIG. 25 is a cross sectional view of FIG. 23, along line 25-25.

FIG. 4 shows a front starboard side perspective view of the receiver cover 10 of FIG. 1. The distal end receiver cover locking mechanism 28 may include an upper clamping member 32 and a lower clamping member 34. The upper clamping member 34 may include a spring loaded lever arm (or cantilever) 36 that is mounted within the distal end (or front end) of the accessory rail. As shown in FIG. 22 and FIG. 23, the spring loaded lever arm 36 may be formed from a lever 38, a fulcrum 40, a pivot 42 and one or more biasing members 44. In the exemplary embodiment, the biasing members 44 may be two compression springs mounted between the bottom surface 46 of the lever arm recess 48 and the lever arm 38 on the proximal side of the fulcrum. Preferably, the compression springs 44 provide a strong and secure clamping force. The spring loaded lever arm 36 may be biased such that the distal end of the lever is positioned toward the lower clamping member 34. By contrast, the lower clamping member 34 may be a static member. For example, the lower clamping member 34 may include a projecting leading edge 50 of the receiver cover. Referring to FIG. 23 and FIG. 24, the projecting edge 50 may be shaped to interconnect with a mating groove 52 on an opposing surface of the AK-47 variant rifle 12. For example, the mating groove 52 may be a curved recess in the rear sight base 20 of the rifle (see e.g., FIG. 24). As shown in FIG. 24 and FIG. 25, when the receiver cover 10 is connected to the rear sight base 14, the projecting keyed edge 50 may rest (or seat) opposite a complimentary shaped ledge 54 on the rear site base 14. Additionally, the spring loaded lever arm 36 and the projecting keyed edge 50 may pinch (or clamp against) the rear sight base 14 to securely fix the distal end of the receiver cover 10 to the AK-47 variant rifle 12.

Figure 5:
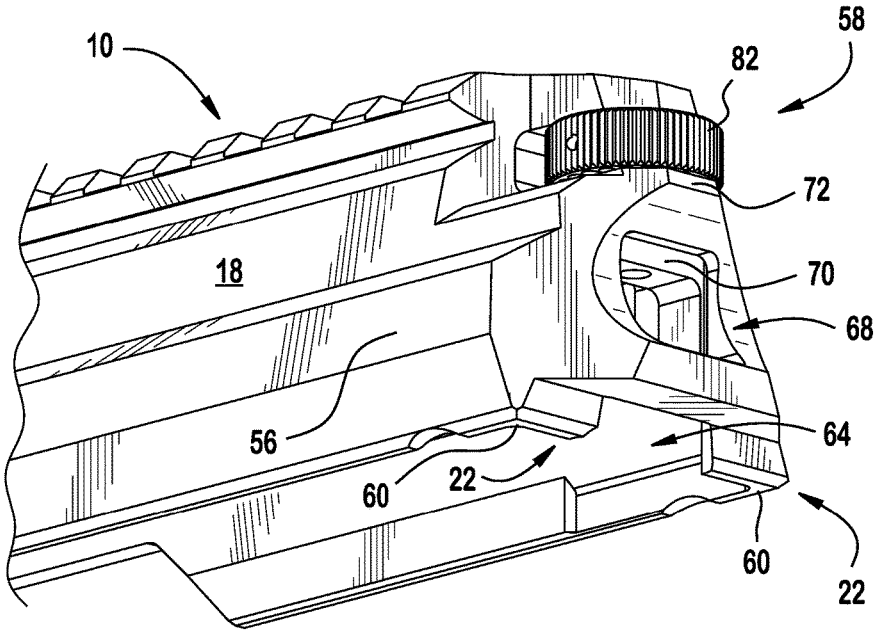
FIG. 5 is a lower rear port side perspective view of the receiver cover of FIG. 1.
Figure 6:
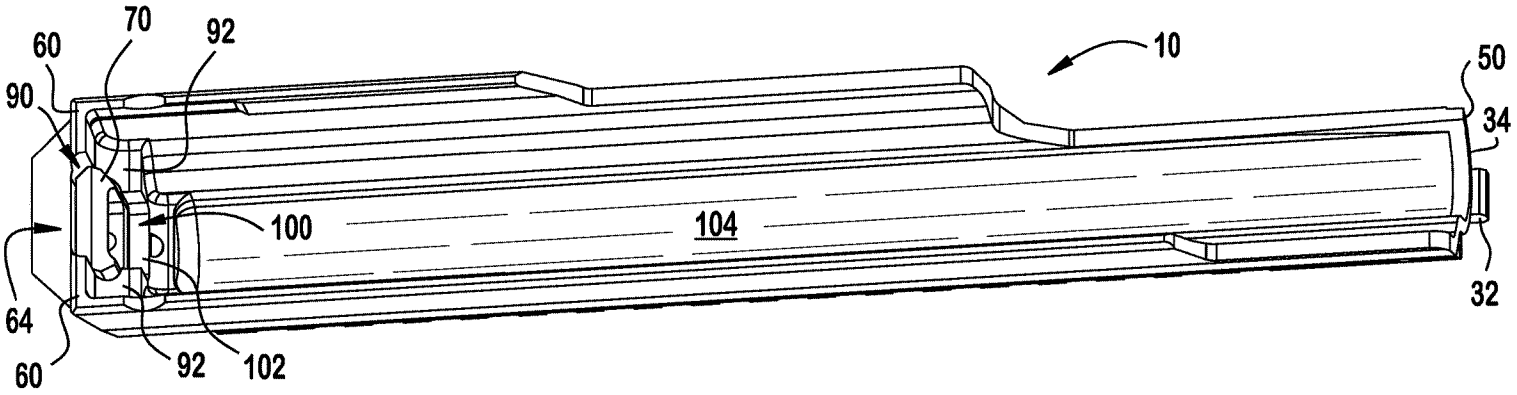
FIG. 6 is a bottom perspective view of the receiver cover of FIG. 1.
Figure 7:
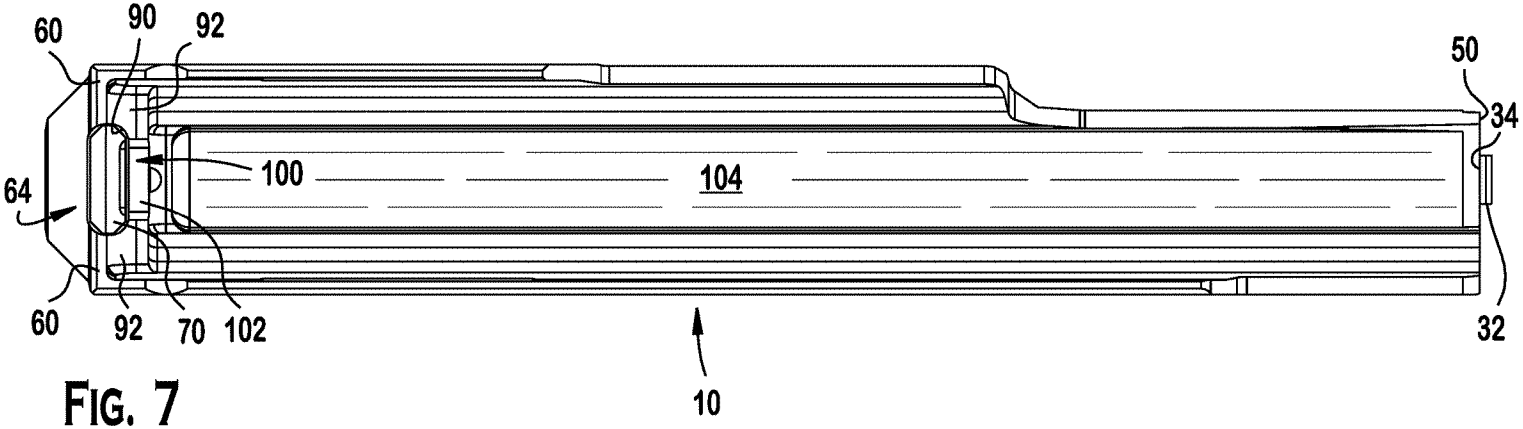
FIG. 7 is a bottom view of the receiver cover of FIG. 1.
Figure 11:
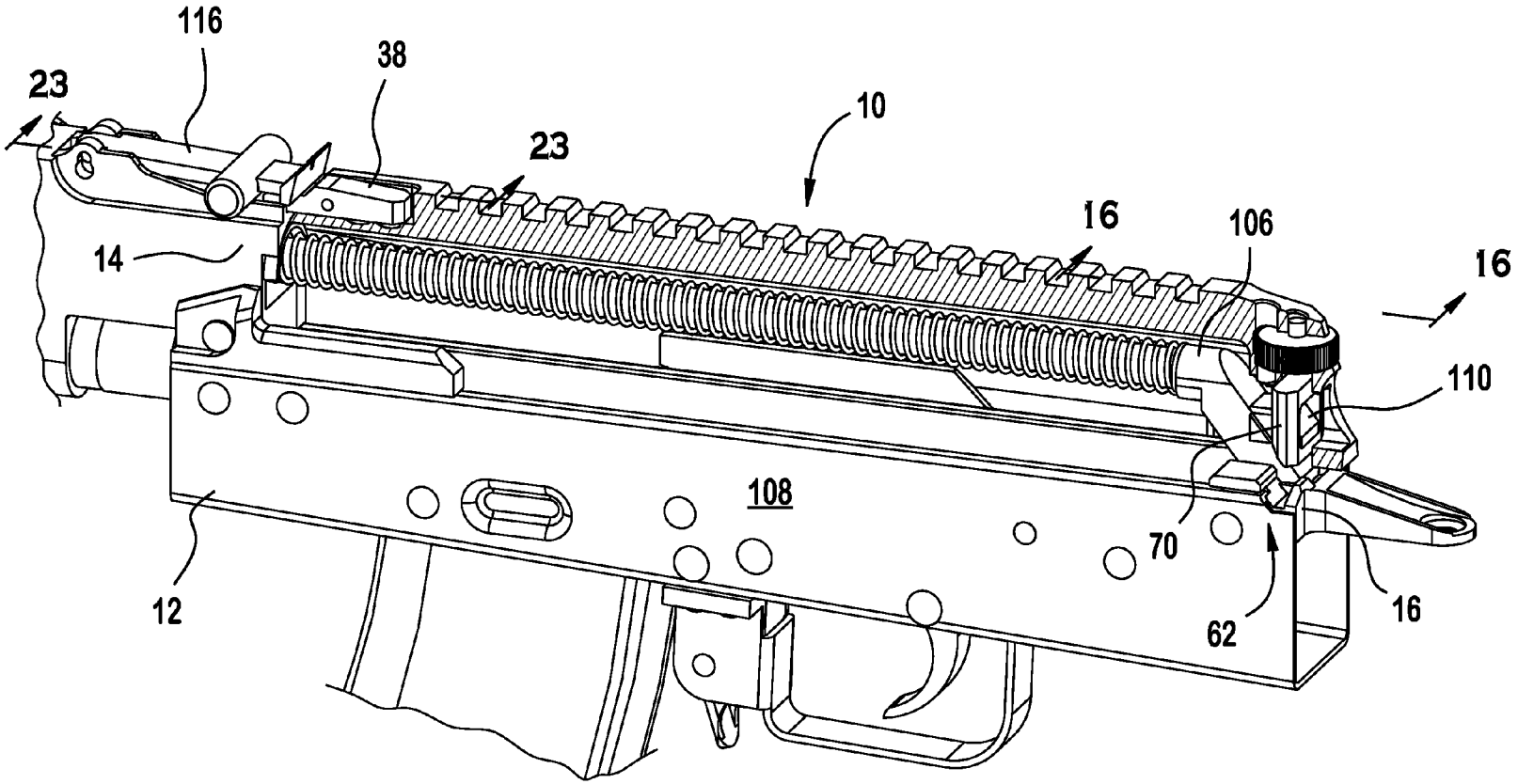
FIG. 11 is partial sectional view of the receiver cover and rifle of FIG. 10.
Figure 12:
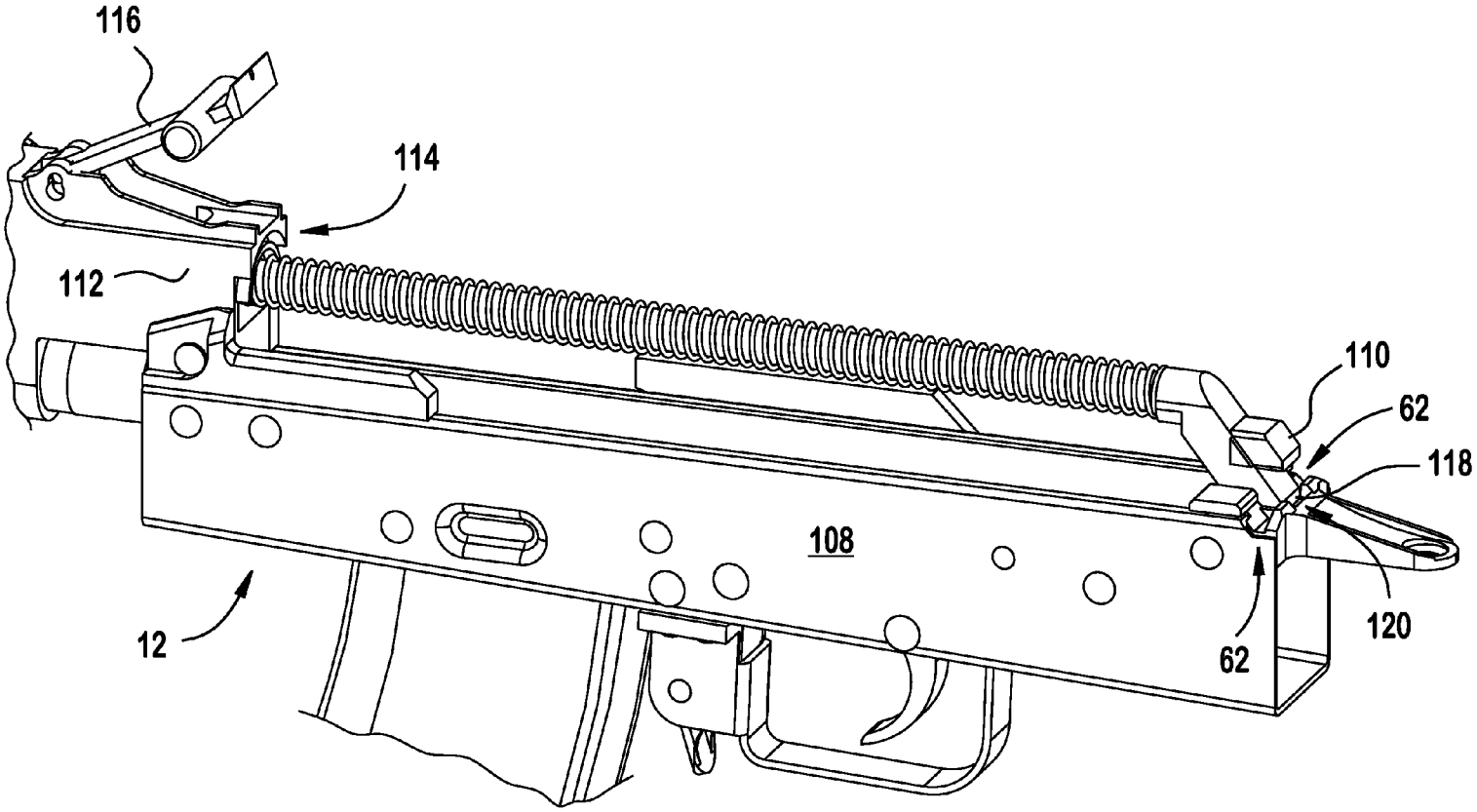
FIG. 12 is a partial perspective view of the rifle of FIG. 11.
Figure 13:
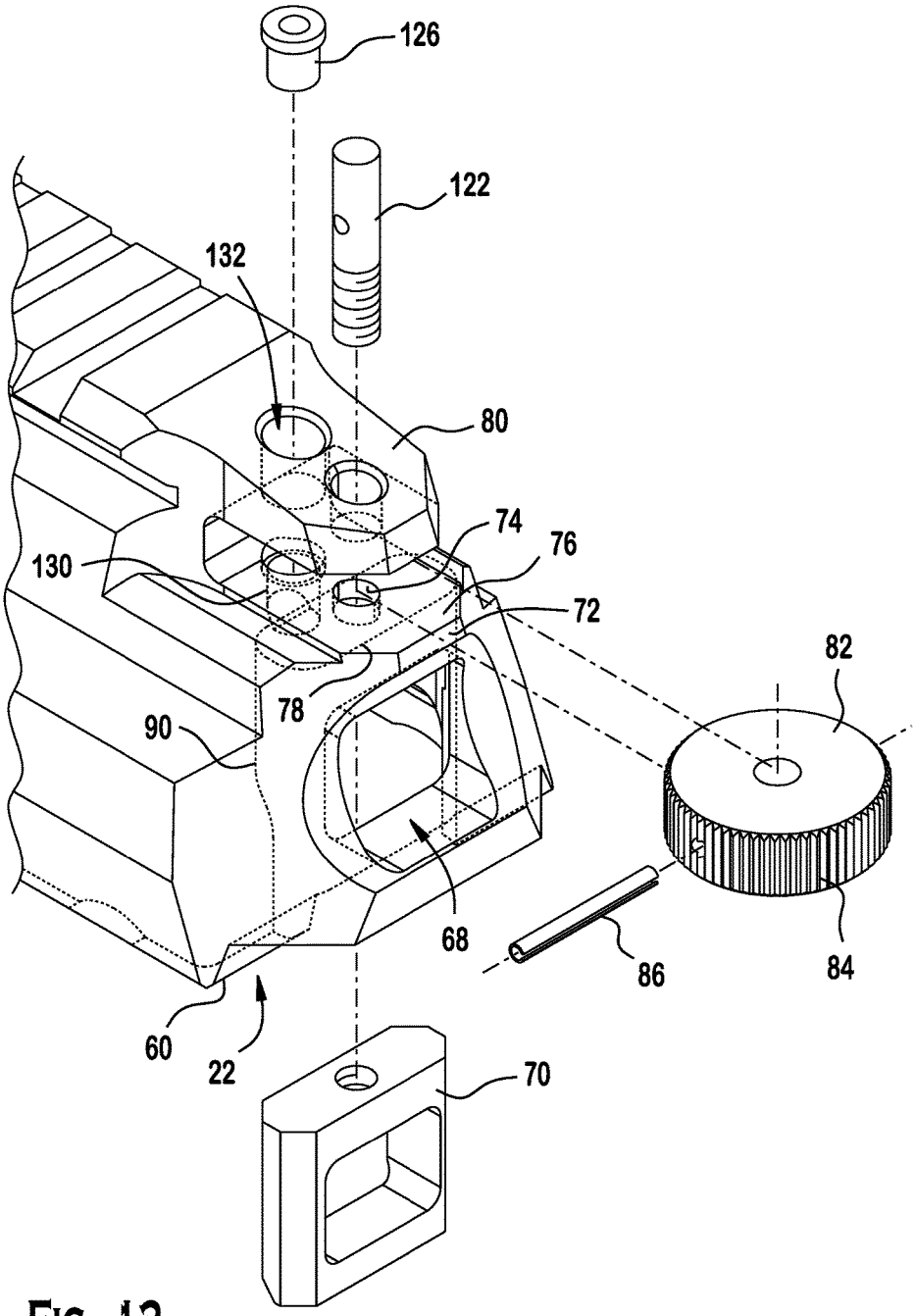
FIG. 13 is an exploded view of the locking mechanism at the rear end of the receiver cover of FIG. 1.
Figure 14:
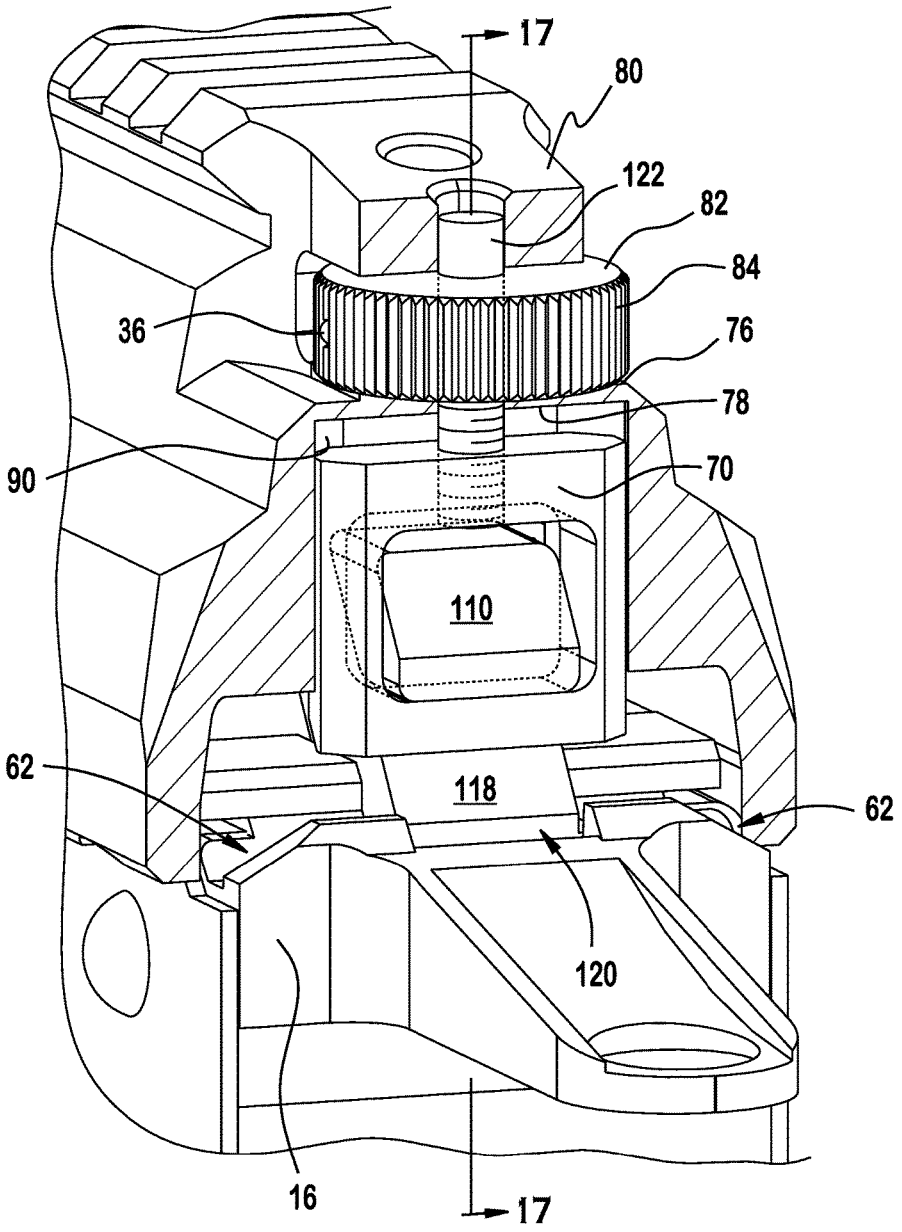
FIG. 14 is a partial sectional view of the rear end of the receiver cover of FIG. 10.
Figure 27:
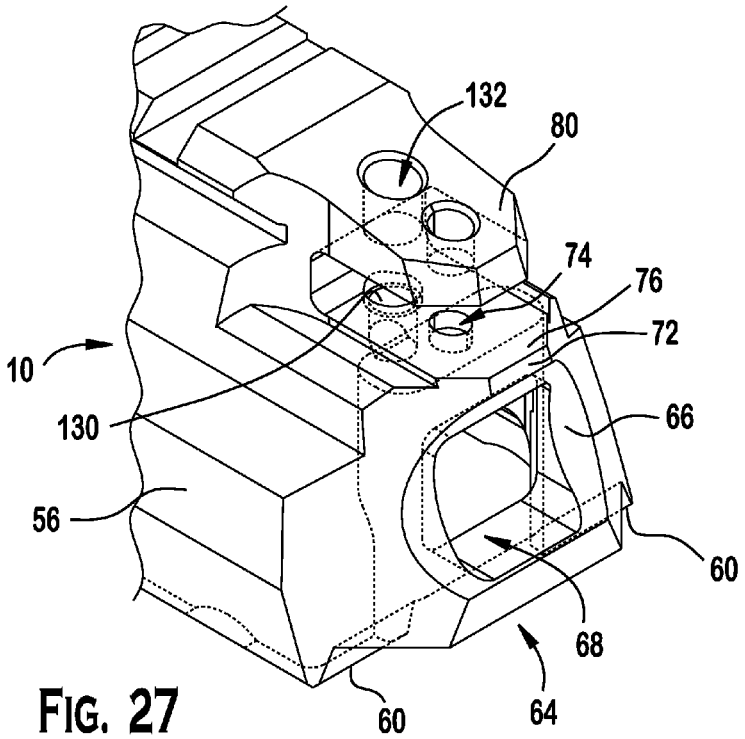
FIG. 27 is an upper port side perspective view of the rear end of the receiver cover of FIG. 1 without selected components of the rear end locking mechanism.

FIG. 5 and FIG. 27 show a rear bottom port side 56 (or right side) view of the receiver cover 10 of FIG. 1. The proximal end portion 58 of the receiver cover 10 may include an inferior proximal rim 60 that mates with a cut (or notch) 62 in the rear trunnion of the AK-47 variant rifle (FIG. 11 and FIG. 12). Disposed between the left and right side inferior proximal rim segments 60 is an exterior channel 64 that provides access to the receiver cover interior at the proximal base of the base of receiver cover. Above the inferior exterior channel 64 is a tapered projection that may include a concave wall 66. The concave wall may surround an opening 68 that provides access to the interior of the receiver cover at a level above the receiver. The proximal opening 68 may provide a passage to a yoke (or ring) 70 that is disposed on the interior side of the proximal opening. Referring to FIG. 13, the tapered projection may further include an inferior ear portion 72, which may include a vertically aligned inferior bore 74. As shown in FIGS. 13, 16, 17, and 18, the inferior bore 74 may extend from the top surface 76 of the tapered projection to an inner side wall 78 adjacent the proximal opening 68. Referring to FIGS. 13, 14, 16, 17, 18 and 19 the proximal end portion of the receiver cover further may include a superior ear 80 and a thumb knob 82 disposed between the superior ear 80 and the inferior ear 72. The thumb knob 82 may include a textured side surface 84, as well as a set screw (or locking pin) 86.

Figure 28:
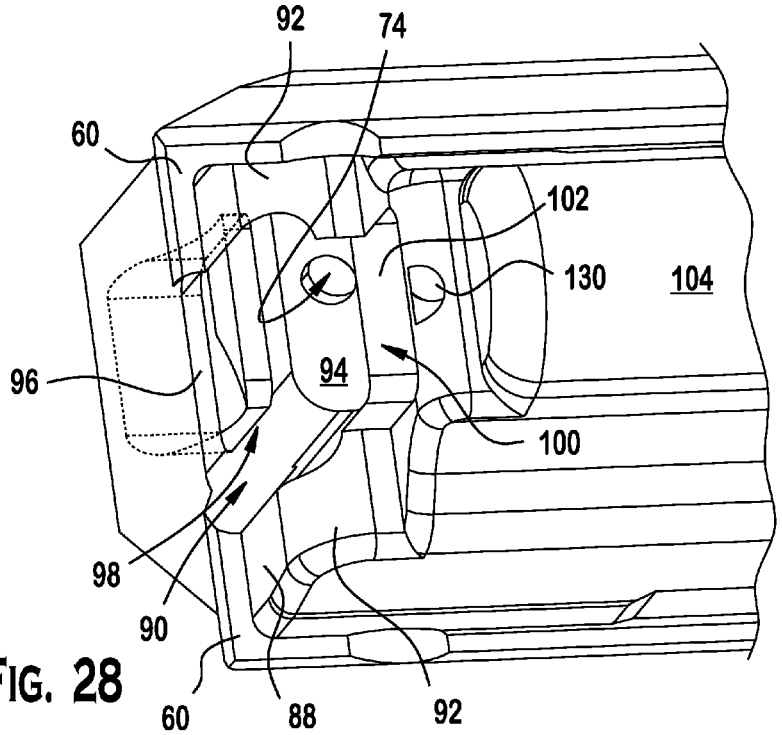
FIG. 28 is a bottom perspective view of FIG. 27.
Figure 29:
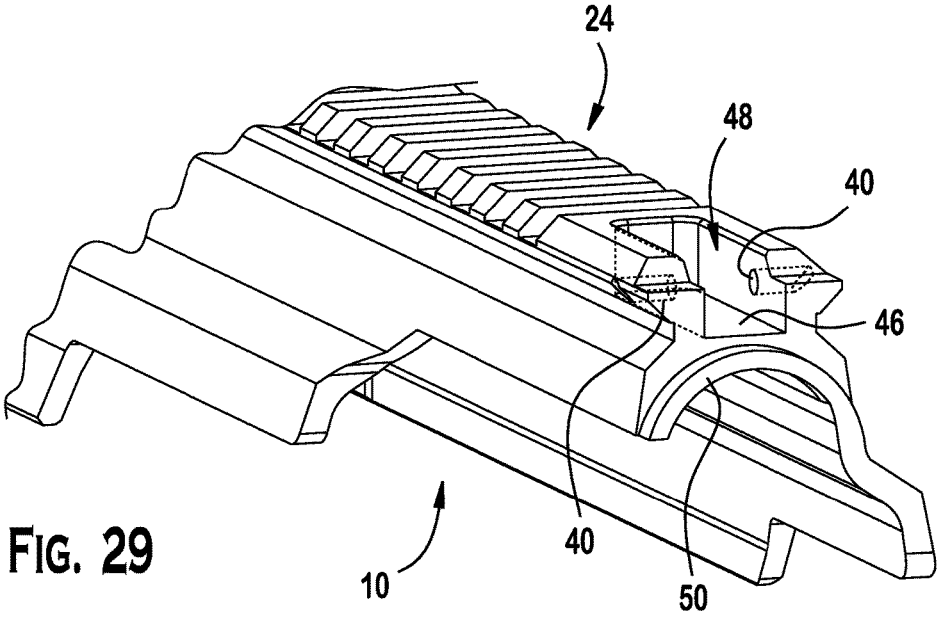
FIG. 29 is an upper starboard side perspective view of the front end of the receiver cover of FIG. 1 without selected components of the front end locking mechanism.
Figure 30:
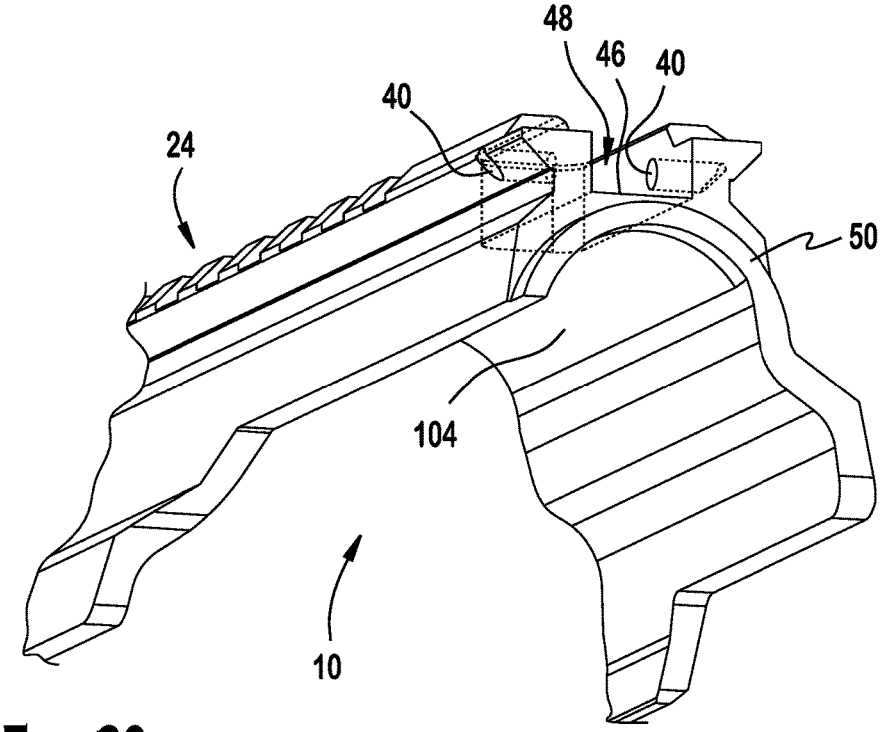
FIG. 30 is a bottom perspective view of FIG. 29.
Figure 31:
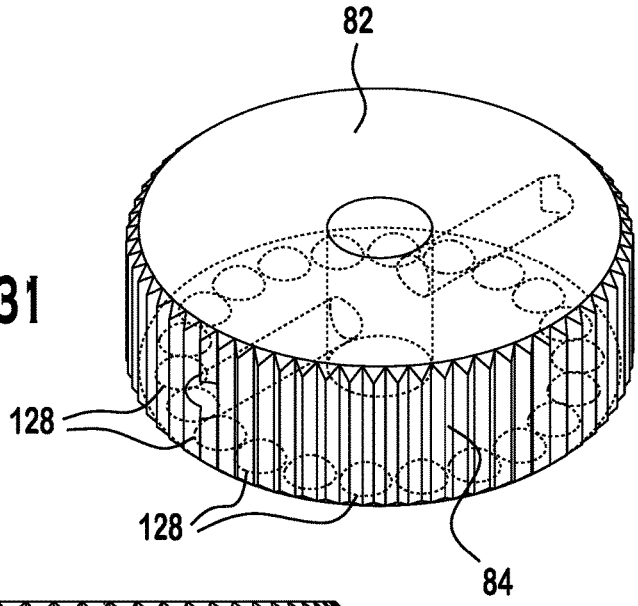
FIG. 31 is a perspective view of the thumb knob of the rear end locking mechanism of FIG. 10.
Figure 32:
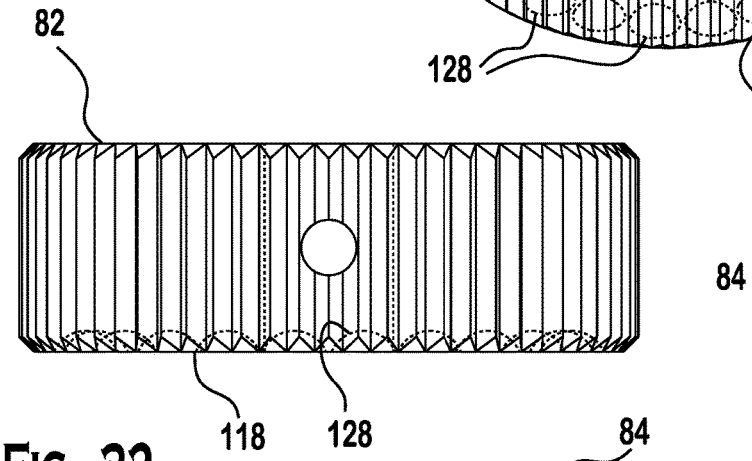
FIG. 32 is a side view of the thumb knob of FIG. 31.
Figure 33:
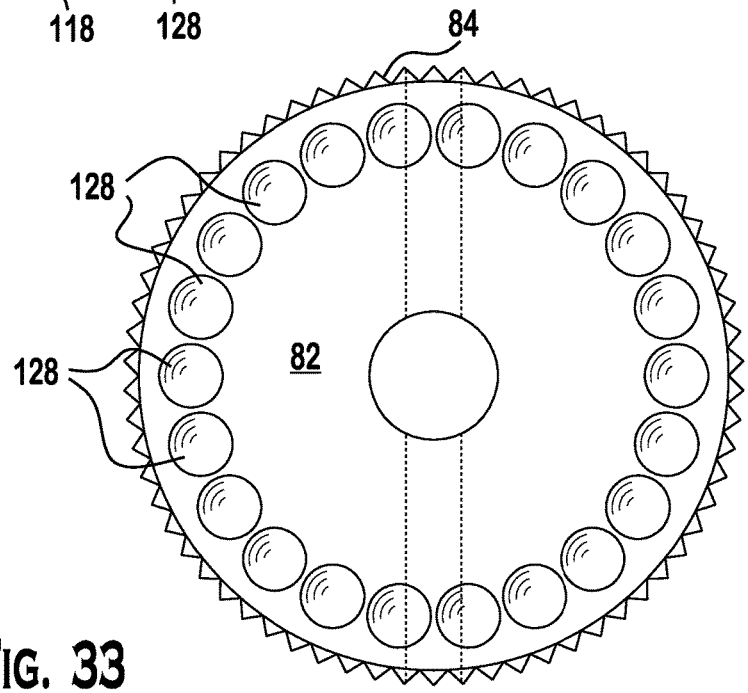
FIG. 33 is a bottom view of the thumb knob of FIG. 31.

FIG. 29 and FIG. 30 show a bottom perspective view of the receiver cover 10. As described above, the distal end of the receiver cover 10 may include a keyed projecting edge 50 and a passage 40 for receiving a pivot pin 42 (not shown) which may secure a spring loaded cantilever that may be housed in the distal end portion of the accessory rail. Referring to FIG. 28, the proximal end wall 88 may include a major interior channel 90, which may be disposed generally perpendicular to the inferior exterior channel 64. The major interior channel 90 may extend into an interior bench 92 in the receiver cover. The end wall 94 of the major exterior channel may form an oval shape and may include the bottom opening of the inferior bore 74. The longitudinal axis of the major interior channel may be aligned with the central axis of the inferior bore. The proximal side wall 96 of the major exterior channel further may include an interior opening 98 of the receiver cover proximal opening 68. Additionally, a minor interior channel 100 may be formed in the interior bench 92 of the receiver cover. The minor interior channel 100 may intersect the major interior channel 90. The minor interior channel 100 may be bounded by lateral side walls. The minor interior channel end wall 102 may form a generally rectangular shaped step that is spaced vertically from the end wall 94 of the major exterior channel and the interior ceiling 104 of the receiver cover.

Figure 34:
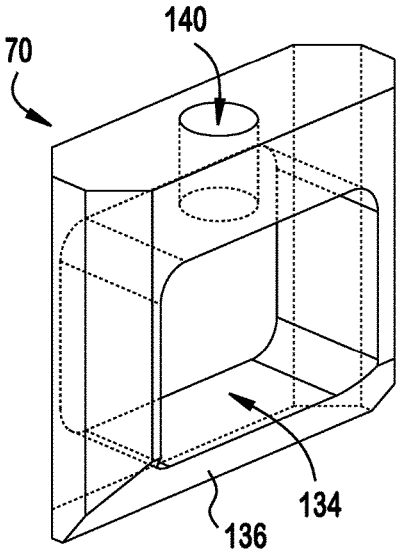
FIG. 34 is a perspective view of the yoke of the rear end locking mechanism of FIG. 10.
Figure 35:
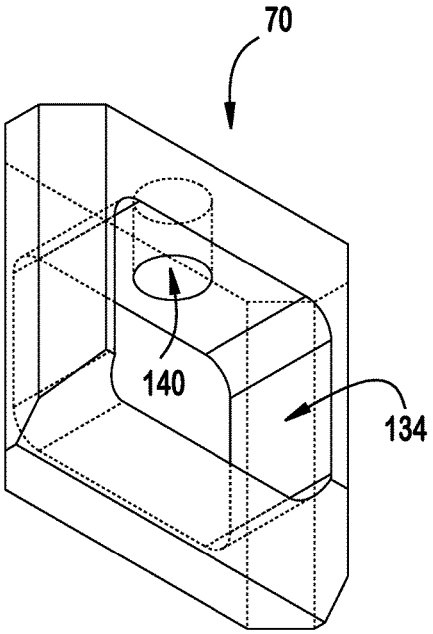
FIG. 35 is another perspective view of the yoke of FIG. 34.
Figure 36:
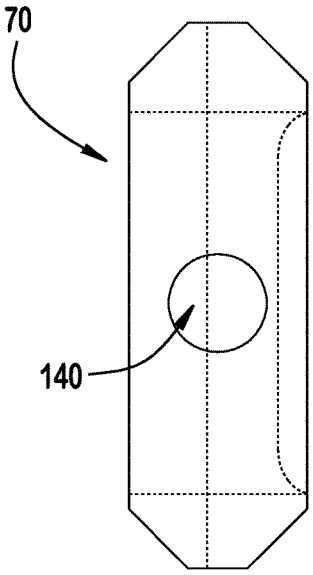
FIG. 36 is a top view of the yoke of FIG. 34.
Figure 37:
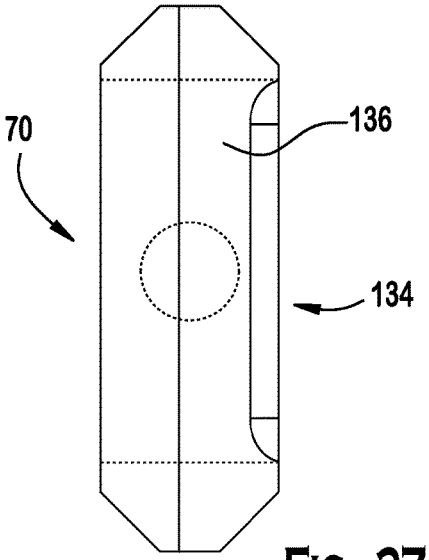
FIG. 37 is a bottom view of the yoke of FIG. 34.
Figure 38:
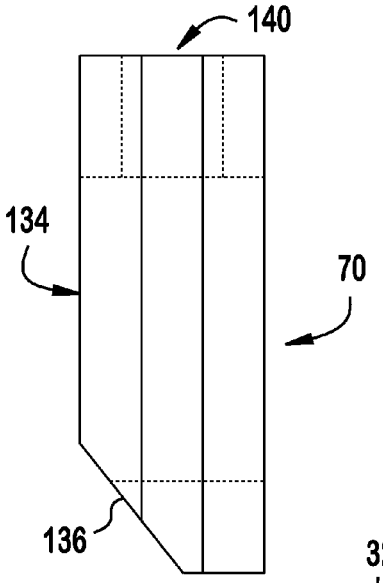
FIG. 38 is a side view of the yoke of FIG. 34.
Figure 39:
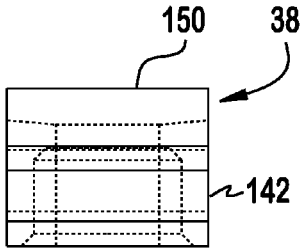
FIG. 39 is a front view of the upper clamping member of the front end locking mechanism of FIG. 10.
Figure 40:
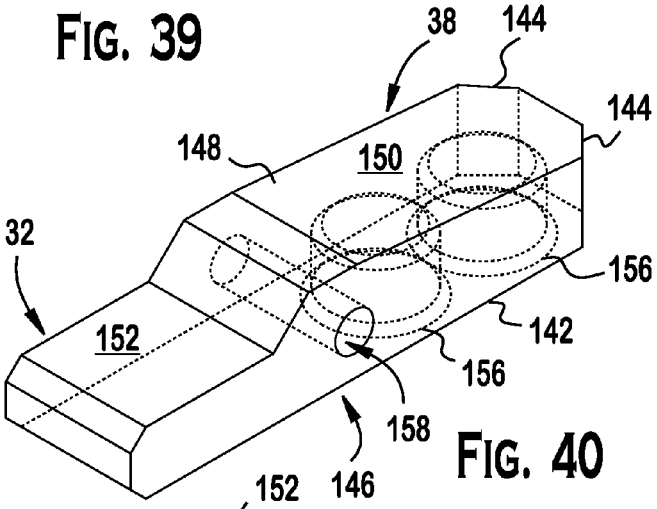
FIG. 40 is an upper front port side perspective view of the upper clamping member of FIG. 39.
Figure 41:
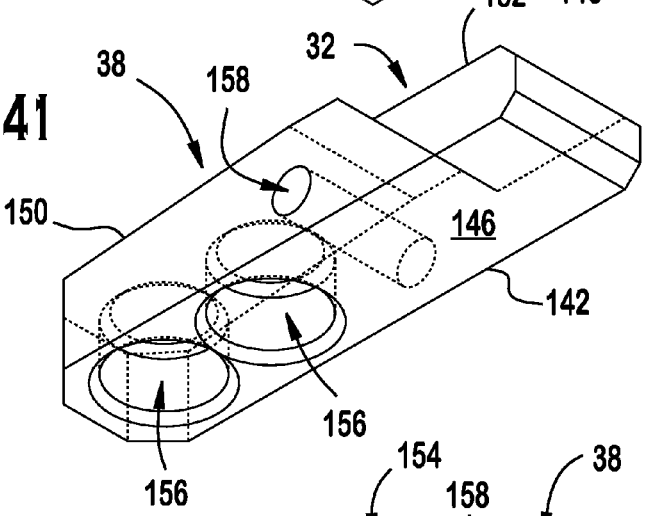
FIG. 41 is a bottom rear port side perspective view of the upper clamping member of FIG. 39.
Figure 42:
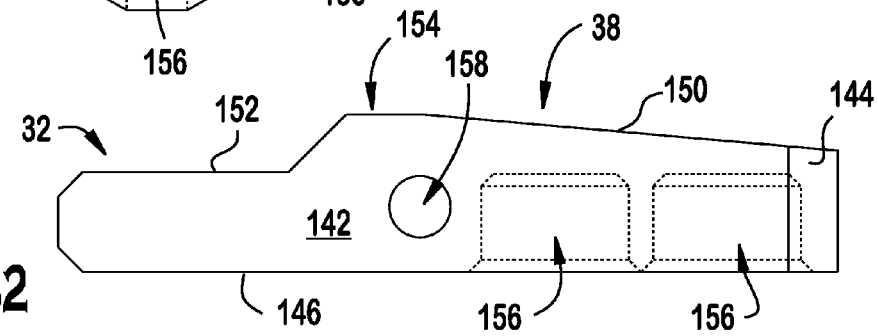
FIG. 42 is a side view of the upper clamping member of FIG. 39.

Referring to FIGS. 6, 7, 13, 14 and 26 an anchor (e.g., a yoke, ring, hook, loop, chain, bar etc) 70 may be disposed in the major interior channel 90. Referring to FIGS. 34, 35, 36, 37 and 38, the anchor 70 may include an internal passage 134 that is sized and positioned within the receiver cover to circumscribe the recoil spring guide button 110 and securely engage the spring guide button 110 when pressed against the spring guide button 110. Although anchor 70 may be configured and dimensioned to circumscribe the spring guide button 110 and engage the bottom surface of the spring guide button 110 to lock the proximal end of the receiver cover 10 to the receiver 108 of the AK-47 variant rifle any suitably shaped structure (e.g., a hook, loop, or a bar) may be used to engage the spring guide or spring guide button 110 provided the spring guide engagement structure may securely interact with the spring guide to fix the receiver cover to the receiver. Although the internal passage may pass from one side the anchor to another side of the anchor, the passage may extend only partly into the body of the anchor. Referring to FIGS. 34 and 38, the anchor 70 may include a flat angled surface 136 that is configured and dimensioned to allow the anchor to slip underneath the spring guide button 110 without contacting a portion of the spring guide 106 between the spring guide button 110 and base of the spring guide 118. For example, referring to FIG. 17, the flat angled surface 136 and the portion of the spring guide 106 between the spring guide button 110 and the base of the spring guide 118 may be parallel to each other.

Figure 10:
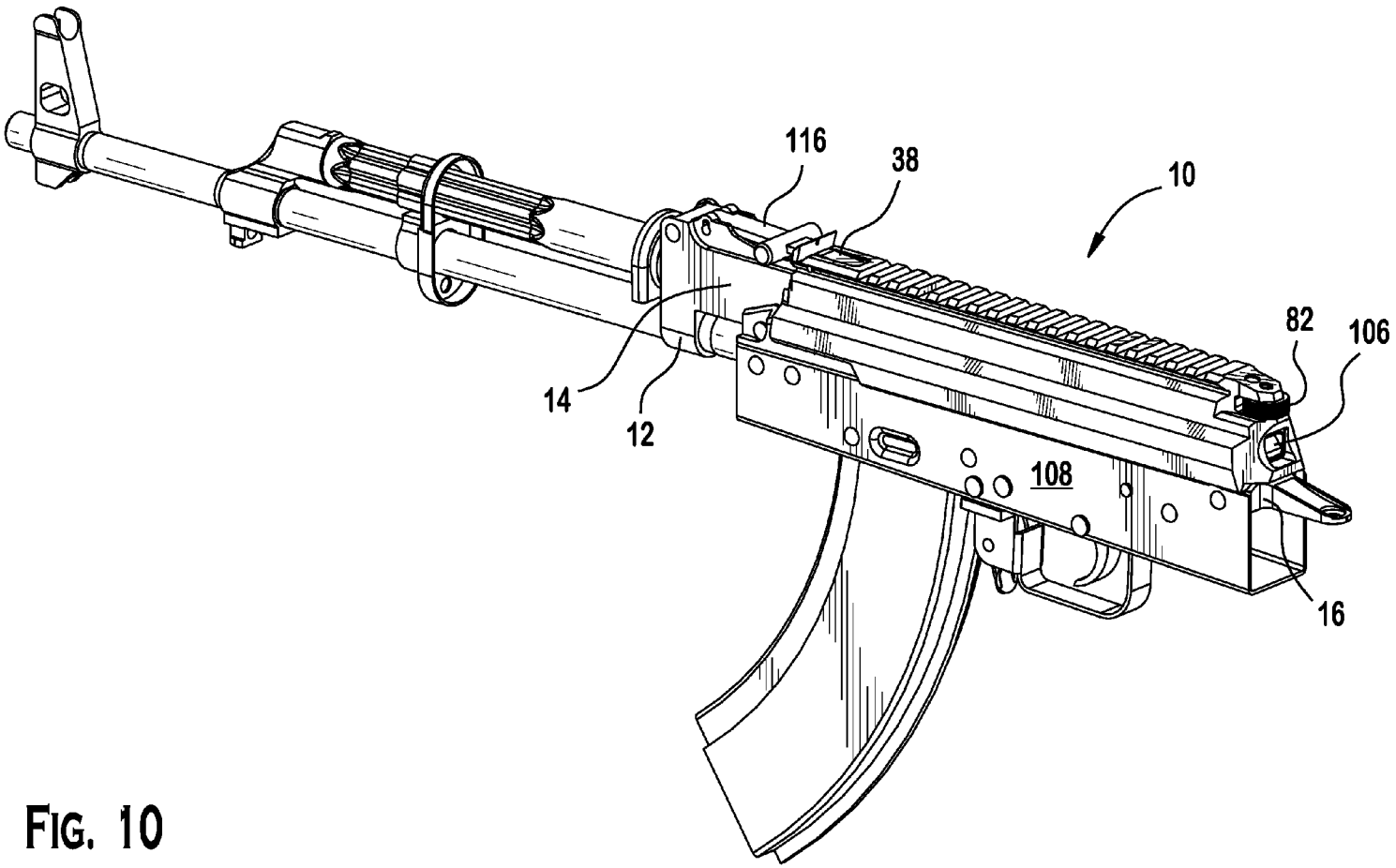
FIG. 10 is a rear perspective view of the receiver cover of FIG. 1 secured to the receiver of a rifle.
Figure 15:
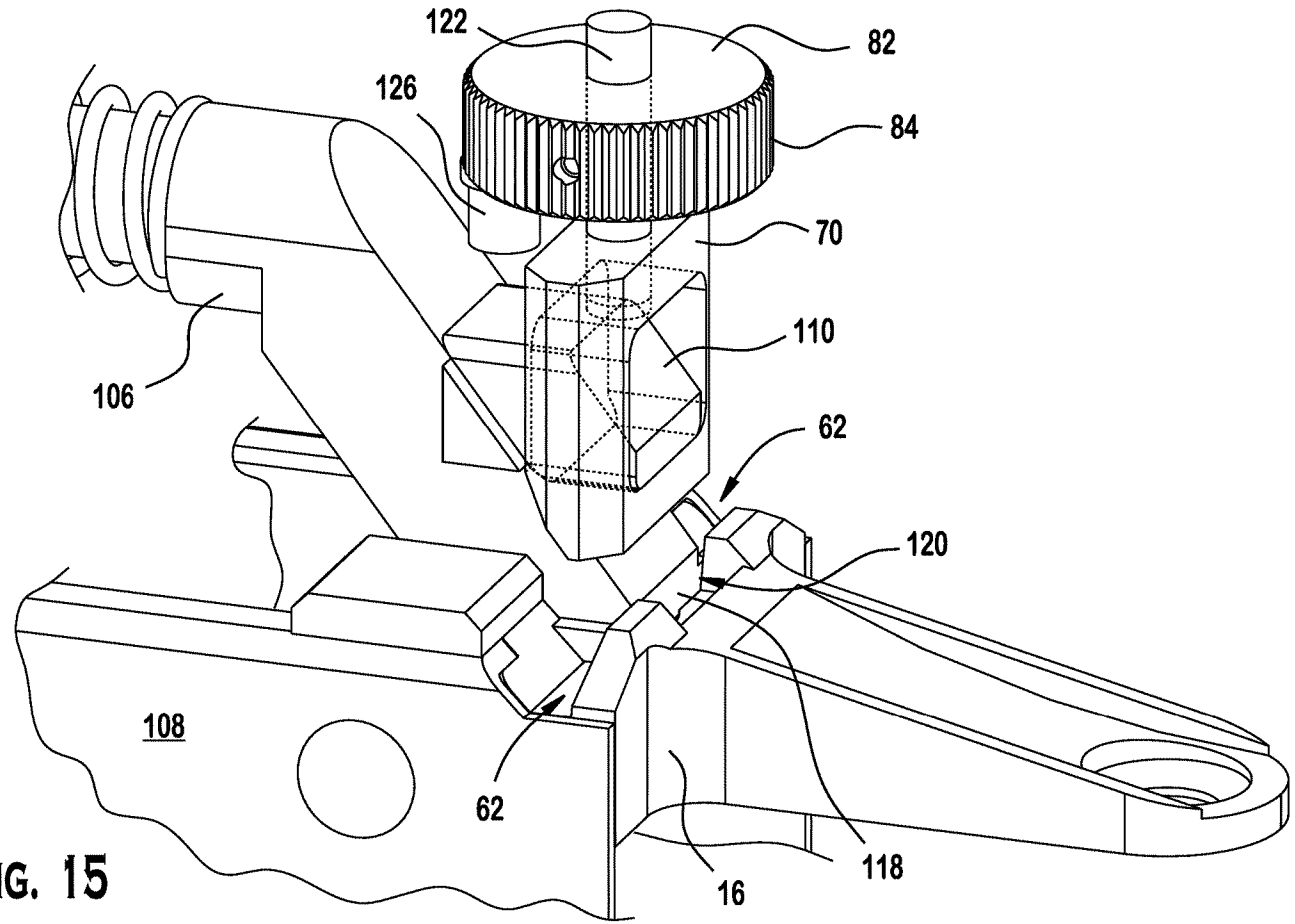
FIG. 15 is a perspective view of selected components of FIG. 10.

Referring to FIGS. 10 and 11, the receiver cover 10 may be connected to an AK-47 variant rifle 12. As shown in FIG. 10, the receiver cover 10 may interlock with the rear sight base 14, the recoil spring guide 106, and the rear trunnion 16 to affect a secure connection between the receiver cover 10 and the receiver 108 of the weapon. As shown in FIG. 11, the rear recoil spring guide button 110 may be positioned within the anchor 70 of the receiver cover. By comparison, FIG. 12 shows the schematic AK-47 variant rifle of FIGS. 10 and 11 without the receiver cover in order to illustrate the location and configuration of the rear sight 116, rear sight base 112 and receiver cover retention groove 114 which mate with the rear site base connection site 20 at the distal (or front) end of the receiver cover, as well as a pair of cuts (or notches) 62 in the rear trunnion 16 for receiving the proximal rim 60 and our trunnion connection site 22 of the receiver cover. Further, FIG. 12 and FIG. 15 shows the base 118 of the recoil spring guide 106 of the AK-47 variant rifle partly secured by the guide slot 120 of the rear trunnion 16.

Figure 16:
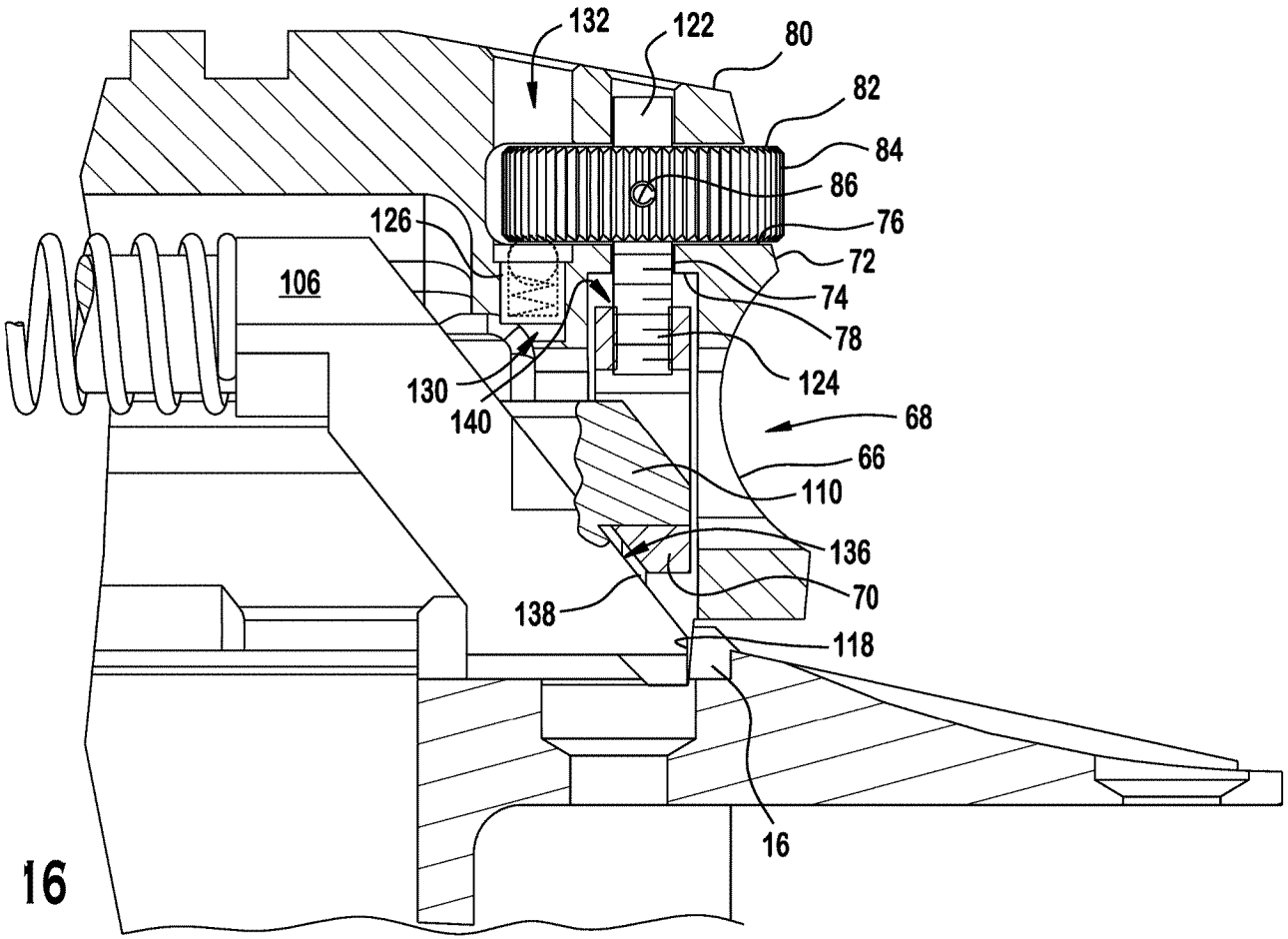
FIG. 16 is a cross sectional view of FIG. 11, along line 16-16.
Figure 17:
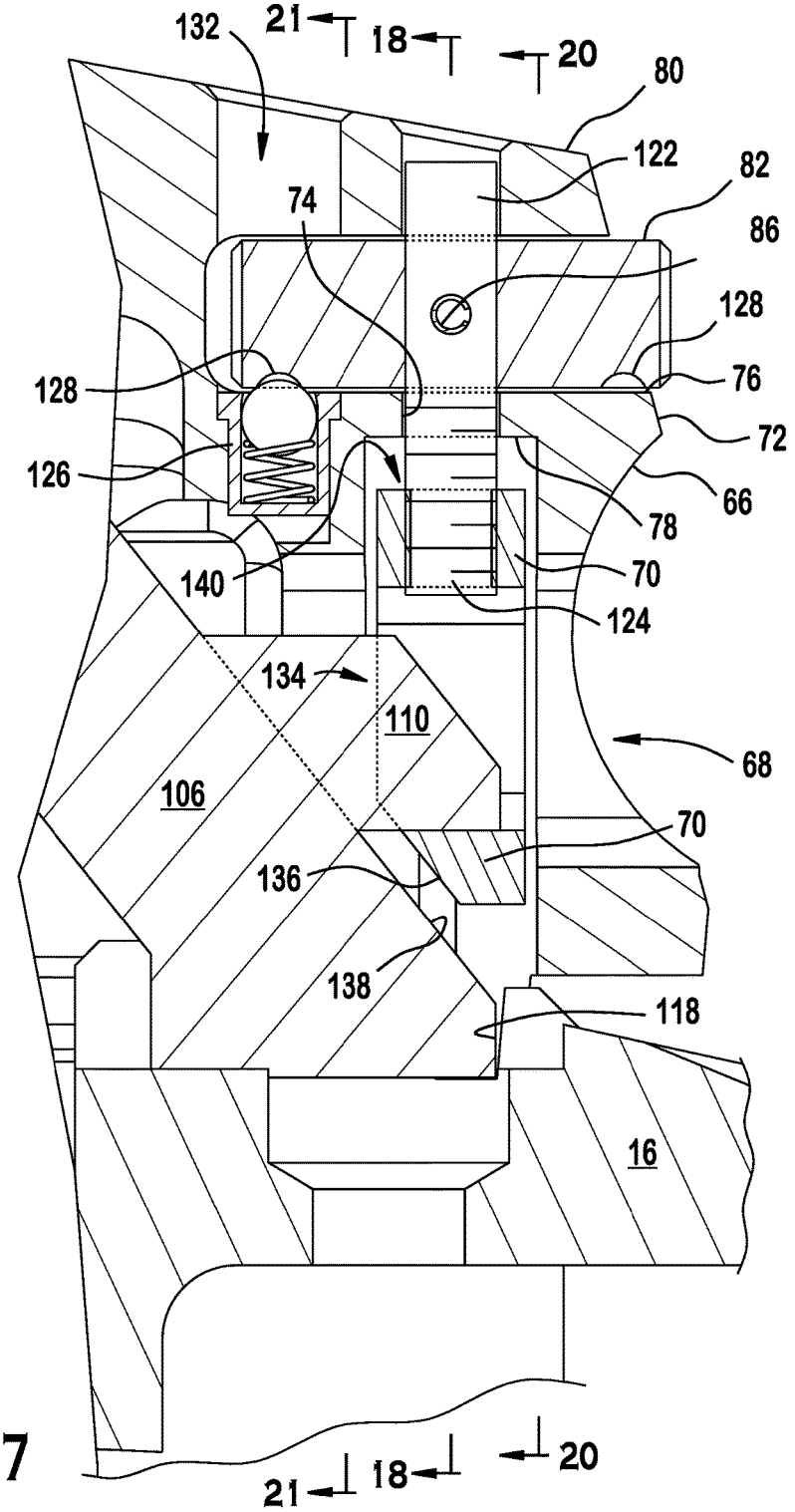
FIG. 17 is a cross sectional view of FIG. 14, along line 17-17.
Figure 18:
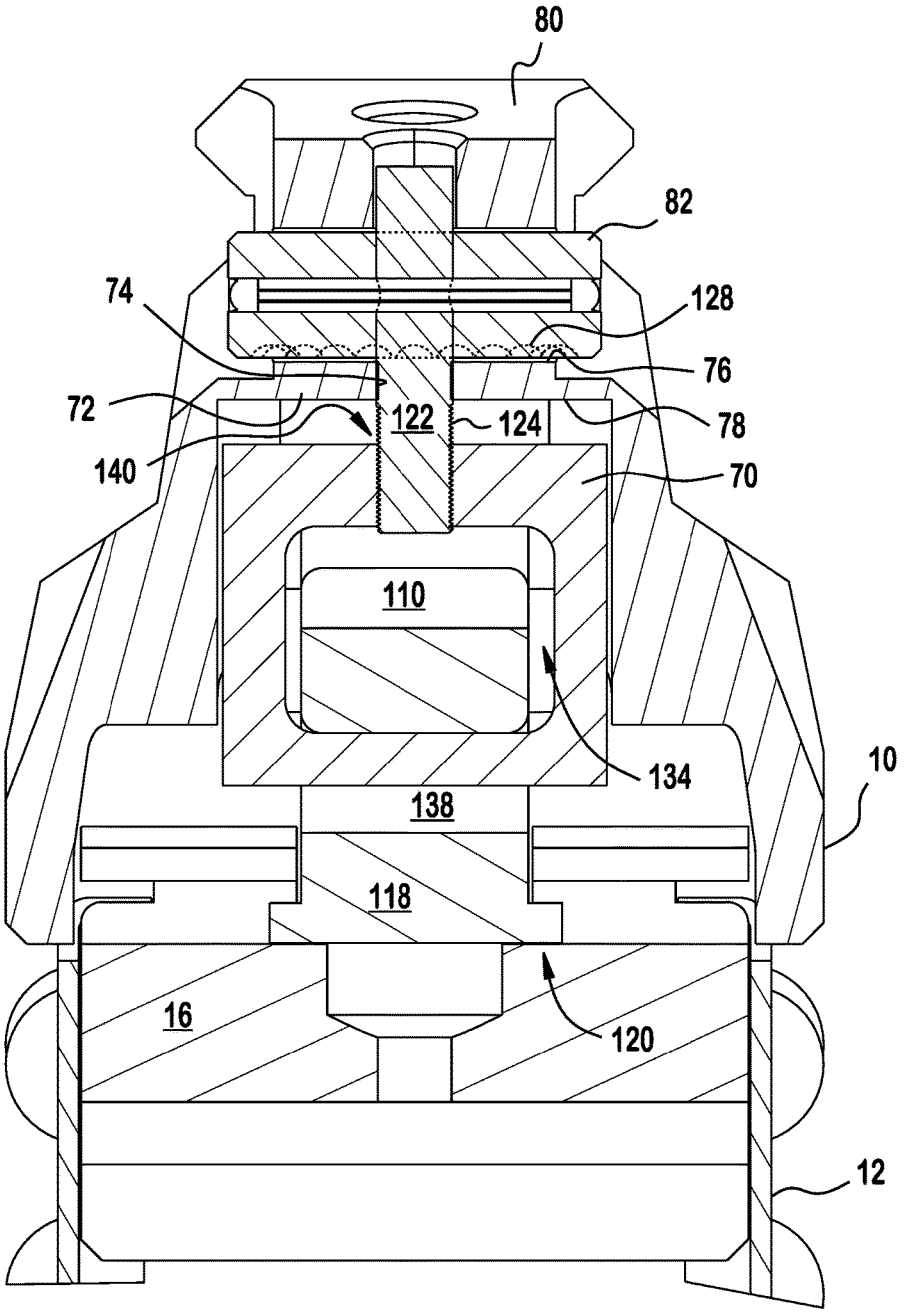
FIG. 18 is a cross sectional view of FIG. 17, along line 18-18.
Figure 19:
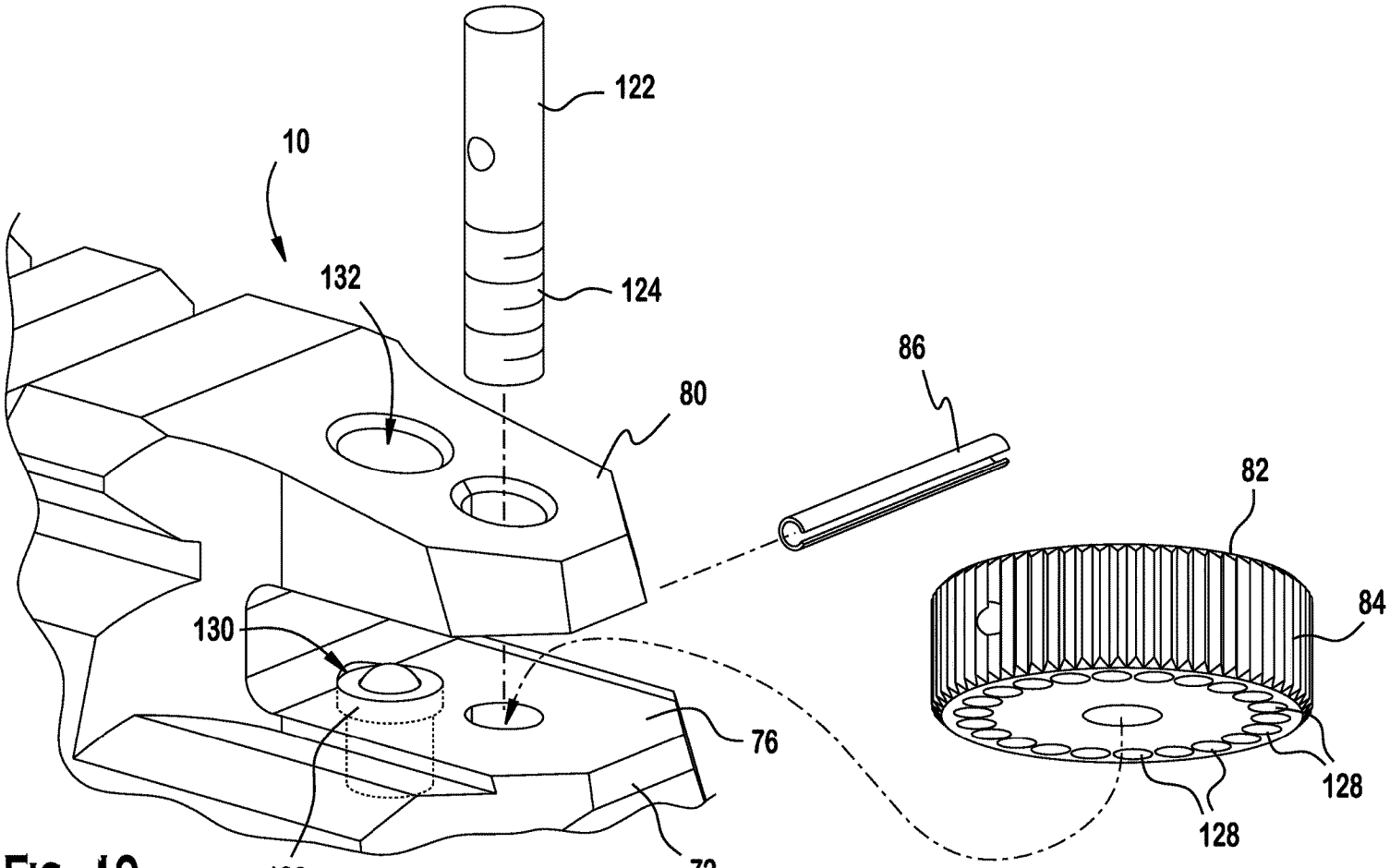
FIG. 19 is a perspective view of selected components of FIG. 10.
Figure 20:
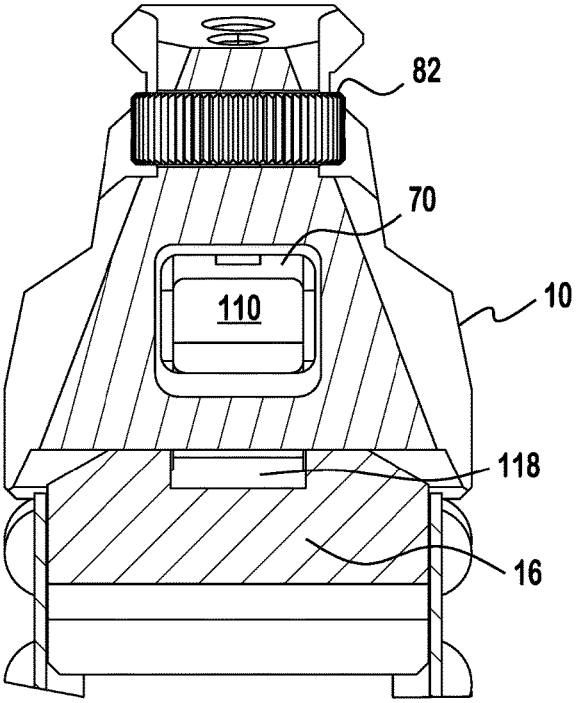
FIG. 20 is a cross sectional view of FIG. 17, along line 20-20.

Referring to FIGS. 14, 15, 16, 17, 18, and 20 the base 118 of the rear recoil spring guide may extend under the anchor 70 and be securely seated in the recoil spring guide slot 120 of the rear trunnion 16. The thumb knob 82, shaft 122 and anchor 70 may be operably associated such that rotating the thumb knob clock-wise moves the anchor toward the thumb knob (i.e., raises the anchor). Similarly, rotation of the thumb knob counter clock-wise may result in movement of the anchor away from the thumb knob (i.e., lowers the anchor). For example, as shown in FIG. 19 the shaft 122 may be threaded 124 and the thumb knob 82 may be fixed to the shaft 122 with a lateral set pin or screw 86. Referring to FIGS. 16, 17 and 18 the bore 140 in the anchor 70 which receives the inferior end of the shaft also may be threaded such that clock-wise rotation of the shaft advances on the anchor, which may be disposed within the major interior channel, and raising it toward the thumb knob. In another example, the interior bore of the thumb knob may be threaded and the anchor may be fixed to the inferior end of the shaft such that rotation of the thumb knob clock-wise advances the shaft upward drawing the anchor toward the thumb knob. Counter rotation of the thumb knob may reverse the process and lower the anchor.

Figure 21:
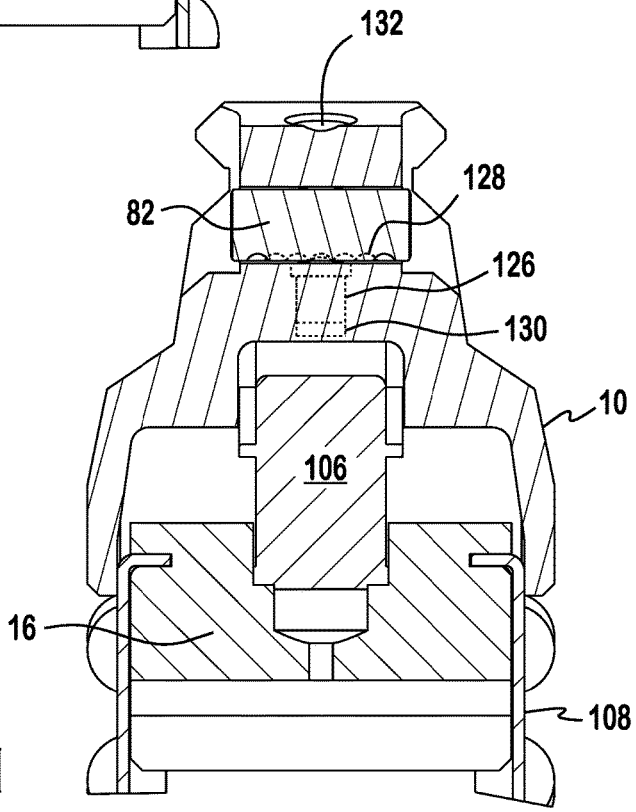
FIG. 21 is a cross sectional view of FIG. 17, along line 21-21.

Referring to FIGS. 16, 17 and 21, the rotation of the thumb knob 82 may be arrested and the position of the thumb knob may be selectively fixed by the presence of a smooth ball spring plunger 126 that is disposed under the peripheral edge of the thumb knob. As shown in FIGS. 17, 18, 19, 21, 31, 32 and 33 the lower surface of the thumb knob 82 may include a plurality of recesses 128. The recesses 128 may be uniformly distributed about the periphery of the thumb knob's lower surface such that they form a circle. Referring to FIG. 17, the ball spring plunger 126 may be positioned such that the spring biases the ball upward into contact with the lower surface of the thumb knob. When the ball spring plunger is aligned with a recess, the spring pushes the ball into the recess to fix the position of the thumb knob. As shown in FIGS. 16, 19 and 21, the smooth ball spring plunger 126 may be seated in a seating bore 130, which is disposed under an access bore 132.

As shown in FIG. 16, the distal end of the receiver cover may be secured to the rear sight base. The projecting keyed edge of the receiver cover may be pushed by an operator into the receiver cover retention groove (see e.g., FIG. 10) as the spring loaded cantilever is held in the raised position by depressing the proximal end of the lever to compress the two compression springs. Once the projecting keyed edge of the receiver cover is disposed in the receiver cover retention groove, the cantilever may be positioned into a lowered position by an operator releasing finger pressure on the proximal end of the lever arm. In the resulting configuration, a portion of the rear sight base is clamped between a distal end portion of the cantilever and the projecting keyed edge of the receiver cover (see e.g. FIG. 17).

Figure 26:
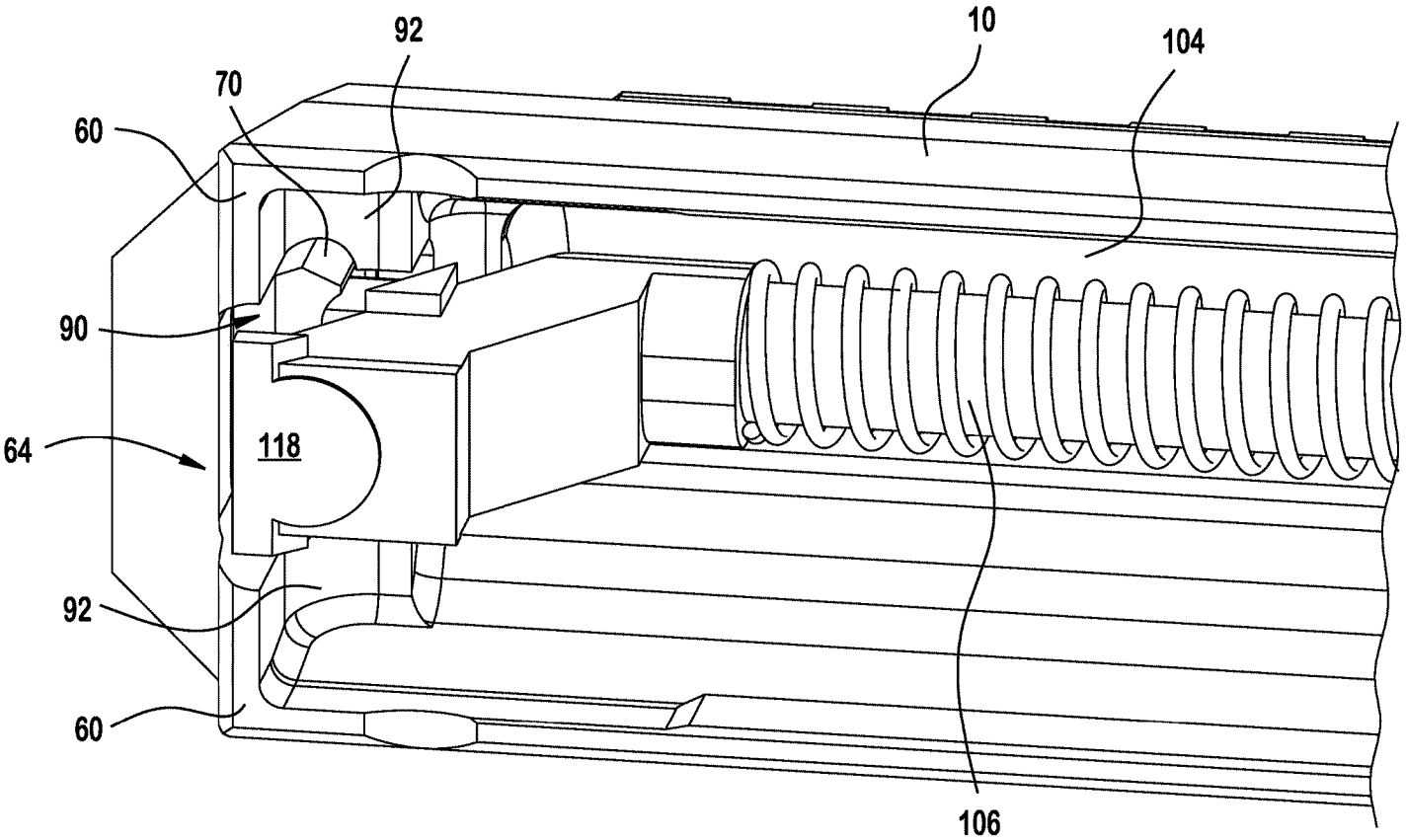
FIG. 26 is a perspective view of selected components of FIG. 10.
Figure 43:
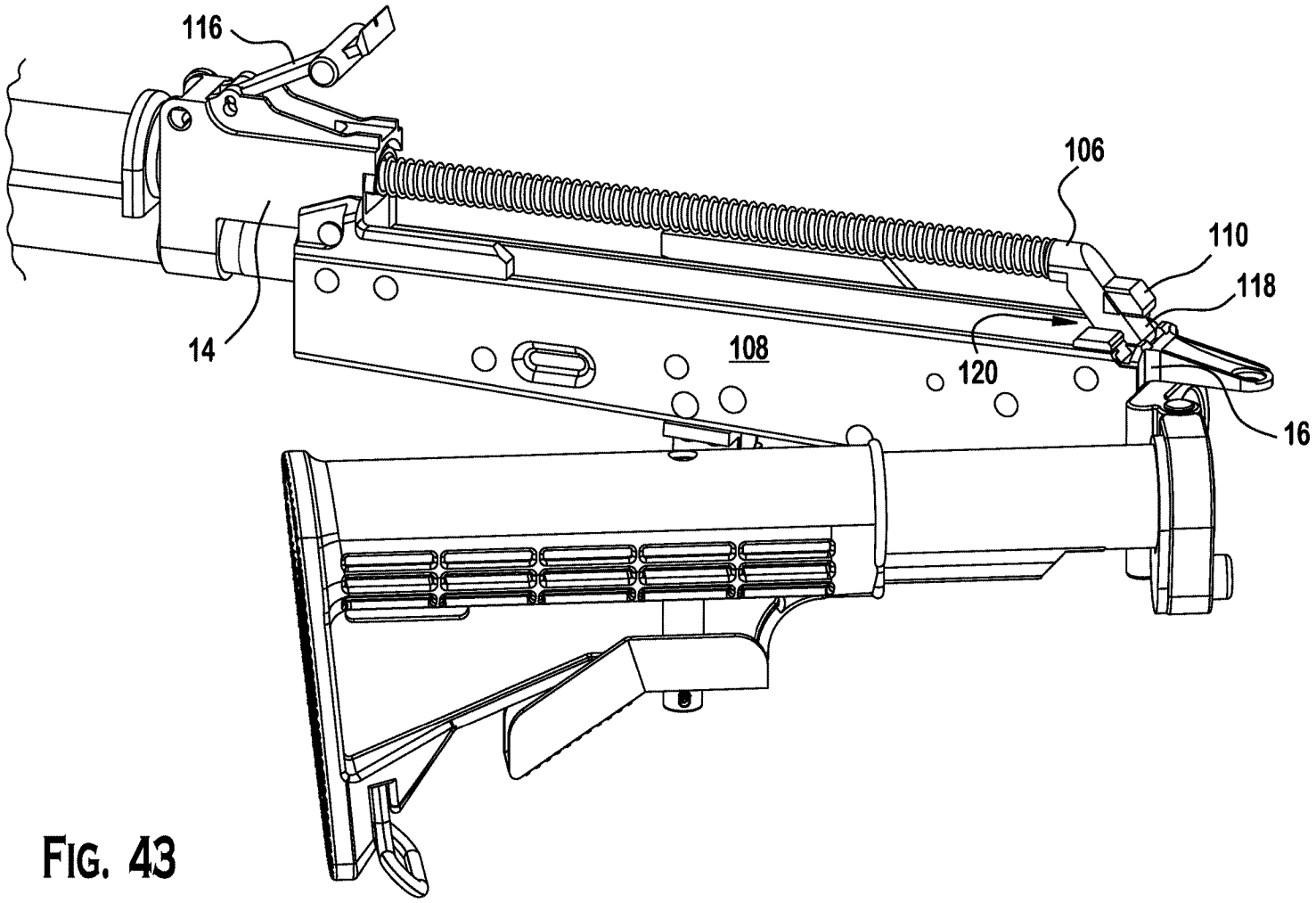
FIG. 43 is a perspective view of an AK-47 rifle with the receiver cover removed.
Figure 44:
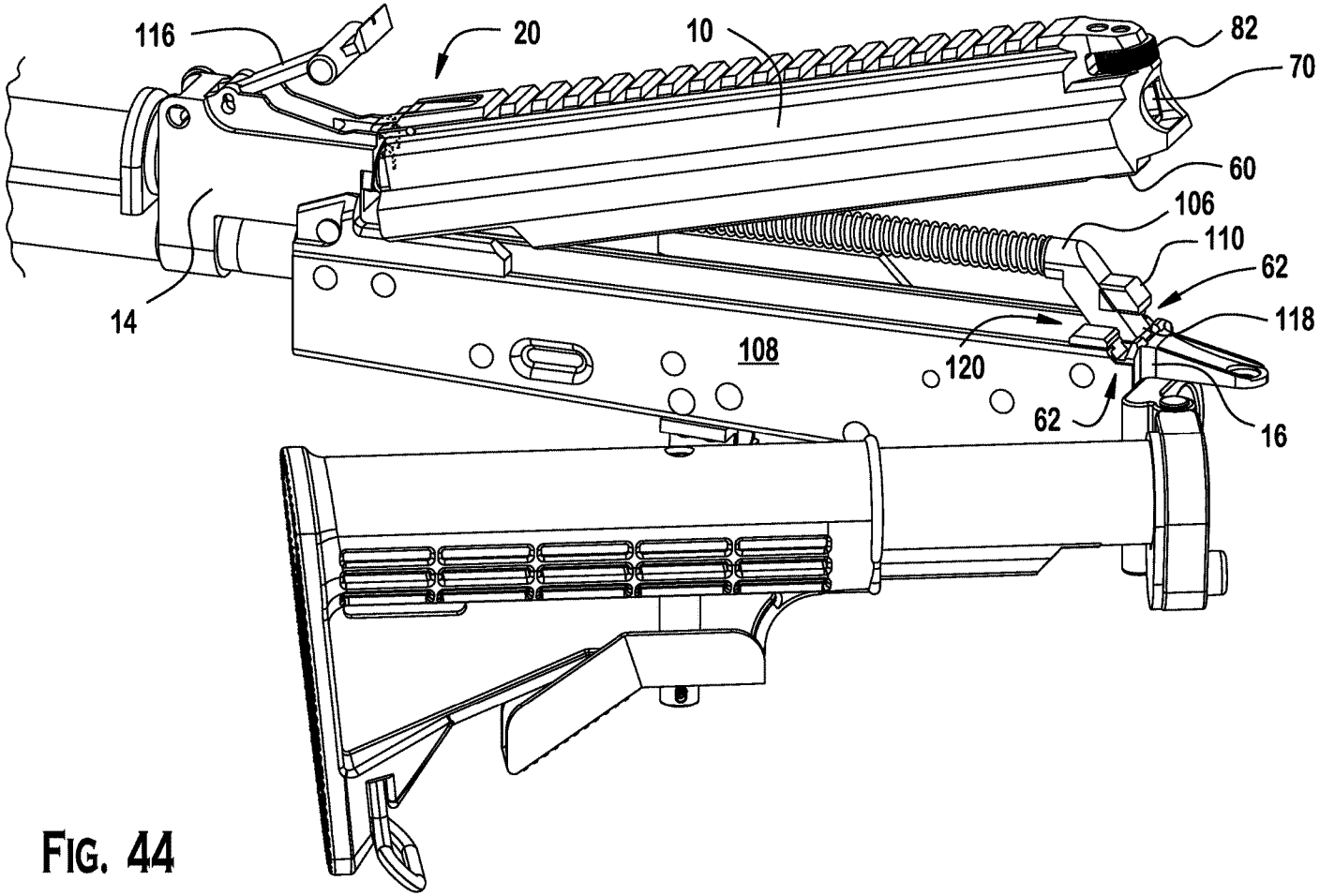
FIG. 44 is a perspective view of the AK-47 rifle of FIG. 43 with the front end of the receiver cover being secured to the rear sight base.
Figure 45:
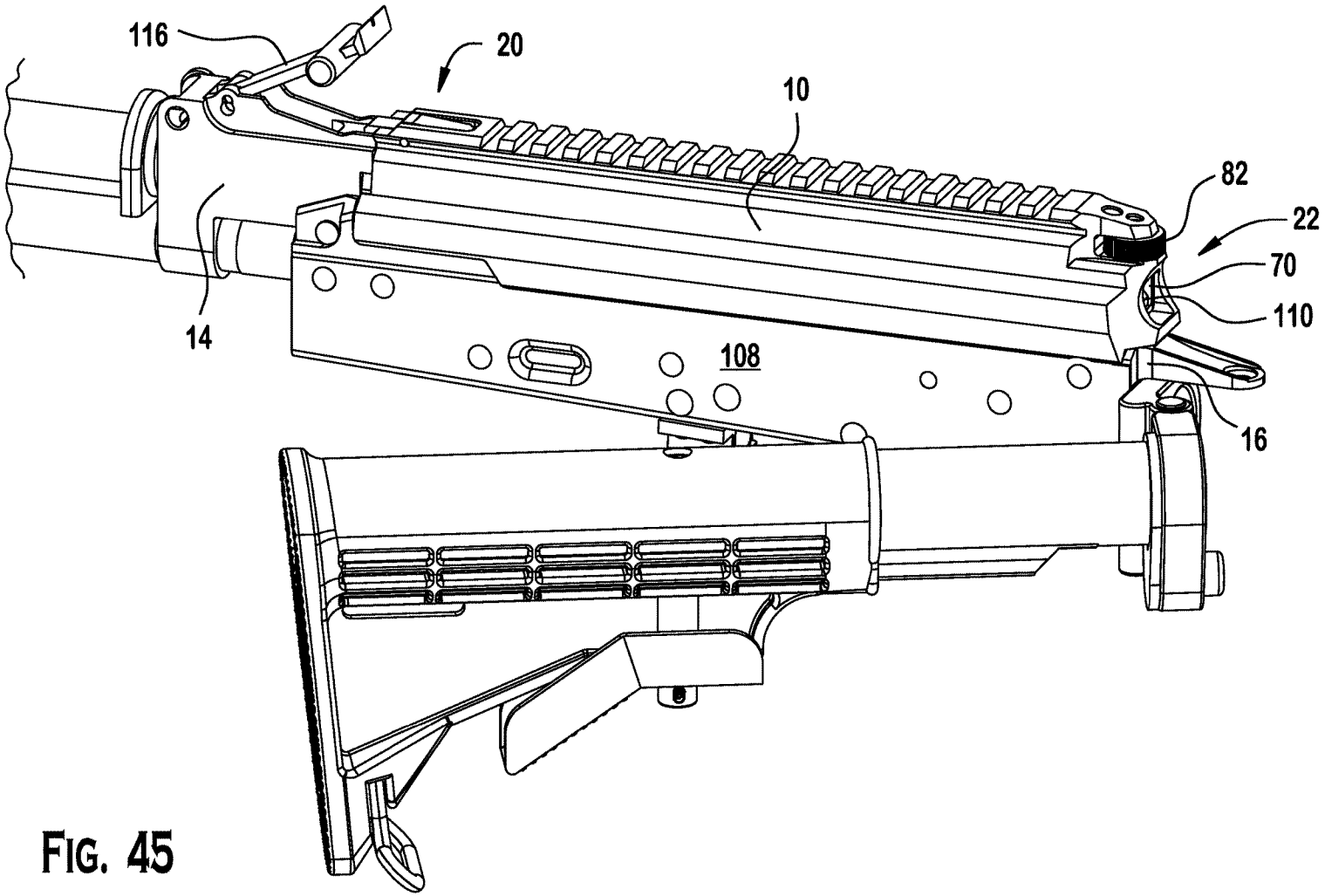
FIG. 45 is a perspective view of the AK-47 rifle of FIG. 43 with the rear end of the receiver cover being secured to the recoil spring guide and rear trunnion.

Referring to FIG. 18 and FIG. 43, the rear recoil spring guide 118 may be positioned inside the recoil spring guide slot 120. As shown in FIGS. 44 and 45, the rear recoil spring guide button 110 be positioned inside the anchor 70. The proximal end of the receiver cover may be lowered such that the proximal rim 60 of the receiver cover 10 may be positioned into a corresponding cut (or notch) 62 in the rear trunnion 16. The corresponding out (or notch) 62 in the rear trunnion may be referred to as a cover connection site. Referring to FIGS. 11 and 45, the thumb knob 82 may be rotated to raise the yoke (or ring) 70. The lower side wall of the anchor 70 may move into contact with the bottom surface of the rear recoil spring guide button 110. As the thumb knob is rotated further the distance between the lower side wall of the anchor and the thumb knob is shortened and the receiver cover 10 is pulled down to seat on the receiver 108 and rear trunnion 16. The thumb knob may be rotated further to lock the proximal end of the receiver cover to the rear trunnion. Referring to FIG. 17, the smooth ball spring plunger 126 may seat inside an opposing recess 128 on the thumb knob 82 to arrest rotation of the knob. As shown in FIG. 26, the base 118 of the rear recoil spring guide 106 may be disposed in the external minor channel 64 when the proximal end of the receiver cover 10 is locked to the rear trunnion 16. The proximal end of the receiver cover may be unlocked from the rear trunnion 16 by counter rotating the thumb knob 82 until the lower side wall of the anchor 70 and the rear recoil spring guide 110 separate. Additional locks or devices may be added to the receiver cover locking mechanisms to provide multi-level locking, and thus prevent unintended dislocation of the primary locking mechanisms. For example, a second level locking device, such as a screw or pin, may be incorporated on the distal end receiver cover locking mechanism to prevent the cantilever from moving after it is engaged with the rear sight base.

FIGS. 39, 40, 41 and 42 show additional views of the exemplary lever of FIG. 22. The lever may be a generally rectangular member. The lever, however, may be configured and dimensioned to rotate within the lever arm recess 48 of the receiver cover without binding. For example, the rear end of lever may be rounded or include one or more beveled surfaces 144 to prevent the lever 38 from pressing against the sides of the lever arm recess or, receiver cover. The lever may have flat bottom surface 146. The lever may have a stepped upper surface 148. The stepped upper surface may include a raised area 150 that is shaped to act as a thumb lever. The stepped upper surface 148 may further include lower surface which cooperates with the bottom surface to form the upper clamping member 32. Also, the lever may have a streamlined contour such that the upper surface of the lever may be generally level with the receiver cover when the lever is positioned by the biasing members 44. The bottom surface may include one or more recesses 156. Each recess may receive a biasing member (e.g., such as a compression spring or leaf spring). The lever may include one or more side surfaces which extend from the stepped upper surface 148 to the bottom surface. A through bore 158 may extend from one side surface to another side surface. The through bore may be sized to receive the pivot 42 and positioned to cooperate with the lever arm recess 48 to form a fulcrum 40 for the spring loaded lever arm 36.

FIG. 45 is another perspective view of an exemplary receiver cover 10 secured to an AK-47 rifle 12. FIG. 43 is a perspective view of an AK-47 rifle 12 with the receiver cover 10 removed. FIG. 44 is a perspective view of the distal end of the exemplary receiver cover 10 secured to the AK-47 rifle 12. The receiver cover may be formed from aluminum and the locking parts may be formed from steel. The smooth ball spring plunger may be Part No. GN 614-NI manufactured by Elsa Ganter. The ball spring plunger may possess a preloaded spring pressure of approximately 2.5 N. The ball spring plunger may possess a maximum load spring pressure of approximately 6 N.

The receiver cover may be manufactured from, without limitation, aircraft quality aluminum, titanium, steel or other alloys, and other materials or combination of materials. The component parts of the distal end receiver cover locking mechanism (e.g., lever, compression springs, pivot pin) and component parts of the proximal end receiver cover locking mechanism (e.g., yoke/ring, shaft, thumb knob) may be formed, without limitation, from titanium, steel or other alloys. Additionally, engineering thermoplastic materials may be used to for the receiver cover. Engineering thermoplastic materials which may be used may include, without limitation, polyphenylene sulphide and partially aromatic nylon materials (e.g., Zytel® HTN).

Figure 8:
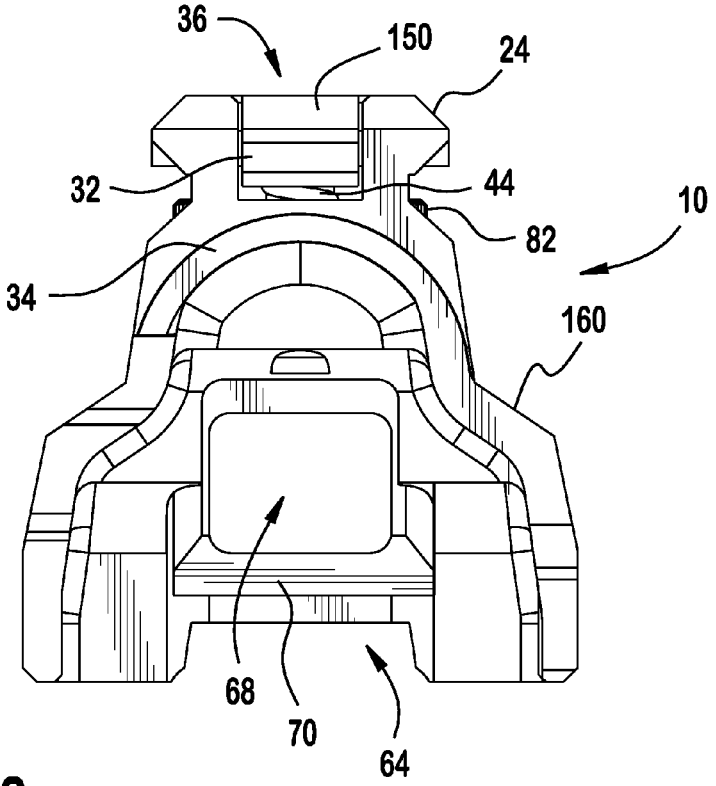
FIG. 8 is a front view of the receiver cover of FIG. 1.
Figure 9:
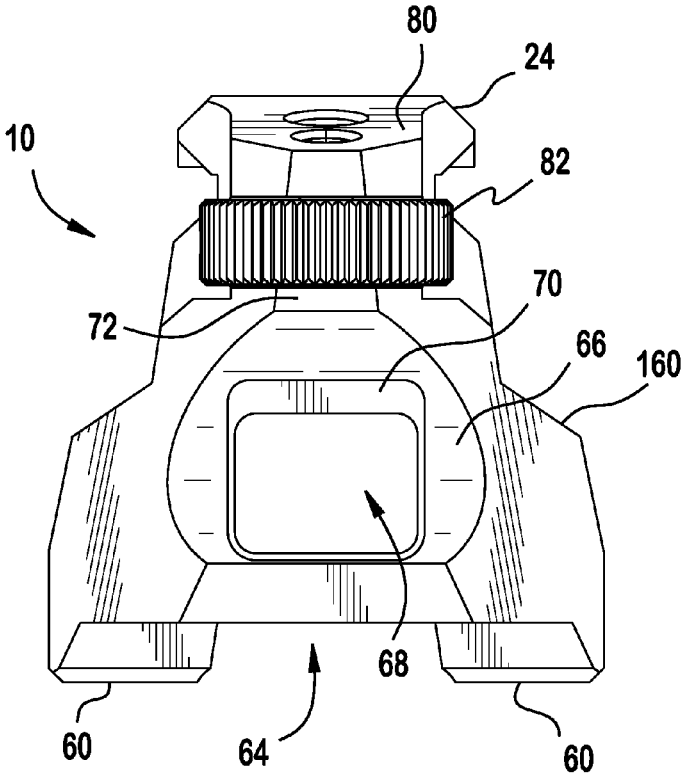
FIG. 9 is a rear view of the receiver cover of FIG. 1.

Referring to FIG. 8 and FIG. 9, the receiver cover 10 may have a tapered profile 160. The tapered profile 160 may prevent the receiver cover 10 from hitting or snagging on environmental structures or equipment. Further, this may facilitate user operation by streamlining a user's view toward an optical accessory that may be mounted on the accessory rail. Additionally, referring to FIG. 8, the thumb knob may be shielded by the front of the receiver cover to prevent the thumb knob 82 from inadvertently being rotated by inadvertent user movement or accidental contact from environmental structures or equipment.

While it has been illustrated and described what at present are considered to be preferred embodiments of the present invention, it will be understood by those skilled in the art that various changes and modifications may be made, and equivalents may be substituted for elements thereof without departing from the true scope of the invention. For example, the thumb knob may be a multi-lobe knob or the compression springs may be augmented or replaced with leaf springs. Additionally, features and or elements from any embodiment may be used singly or in combination with other embodiments. Therefore, it is intended that the specification and examples be considered as exemplary only, with a true scope and spirit of the embodiments being indicated by the following claims.

What is claimed is:

1. A cover for a receiver of a gun comprising:

an elongated member having a first longitudinal axis, the elongated member comprising a distal end portion which comprises;

a leading edge which is configured and dimensioned to connect with a gun part; and a proximal end portion which is spaced from the distal end portion along the first longitudinal axis, and which comprises a proximal end wall, a proximal rim adjacent the proximal end wall, a first locking mechanism adjacent the proximal end wall which comprises an anchor, and a positioning member connected to the anchor such that movement of the positioning member moves the anchor with respect to the proximal rim, and a blocking member operatively associated with the positioning member the first locking mechanism comprising first and second operable configurations such that in the first configuration the blocking member arrests movement of the positioning member and in the second configuration the blocking member allows movement of the positioning member.

2. The cover of claim 1, wherein the positioning member is movable with respect to the anchor.

3. The cover of claim 2, wherein the positioning member is rotatable with respect to the anchor.

4. The cover of claim 3, wherein the positioning member and the anchor are connected by mating screw threads.

5. The cover of claim 3, wherein rotation of the positioning member in one direction moves the anchor away from the proximal rim.

6. The cover of claim 5, wherein counter rotation of the positioning member moves the anchor toward the proximal rim.

7. The cover of claim 1, wherein the anchor comprises
a body which comprises
a first surface,
a second surface spaced from the first surface, and
a passage extending from the first surface toward the second surface, the passage comprising a first side wall.

8. The cover of claim 7, wherein the first side wall is situated between the proximal rim and the blocking member.

9. The cover of claim 8, wherein the first side wall is positioned to anchor against a recoil spring guide of a gun.

10. The cover of claim 9, wherein the passage extends from the first surface to the second surface.

11. The cover of claim 1, wherein the positioning member comprises a shaft that is connected to the anchor.

12. The cover of claim 11, wherein the positioning member further comprises a knob connected to the shaft such that moving the knob regulates the position of the anchor with respect to the proximal rim.

13. The cover of claim 12, wherein the knob comprises a first exterior surface, and the first exterior surface comprises a plurality of recesses, the plurality of recesses being selectively positionable opposite the blocking member.

14. The cover of claim 13, wherein each of the plurality of recesses are configured and dimensioned to engage the blocking member to fix the position of the knob.

15. The cover of claim 14, wherein the blocking member comprises a smooth ball spring plunger.

16. The cover of claim 11, wherein the shaft comprises a second longitudinal axis and the knob is rotatable about the second longitudinal axis.

17. The cover of claim 16, wherein the knob is fixed to the shaft.

18. The cover of claim 1, further comprising a second locking mechanism adjacent the distal end portion which comprises
a lever which comprises a distal end and a proximal end, the distal end of the lever being positioned adjacent the leading edge, and
a biasing member positioned between the elongated member and the lever,
the second locking mechanism comprising third and fourth configurations such that in the third configuration the distal end of the lever is biased toward the leading edge, and such that in the fourth configuration the proximal end of the lever compresses the biasing member.

19. The cover of claim 1, wherein the elongated member comprises a tactical accessory rail.

20. The cover of claim 1, wherein the elongated member is configured and dimensioned to form a cover for a receiver of an AK-47 variant rifle.

* * * * *